US007095273B2

(12) United States Patent
Sato et al.

(10) Patent No.: US 7,095,273 B2
(45) Date of Patent: Aug. 22, 2006

(54) VOLTAGE GENERATOR CIRCUIT AND METHOD FOR CONTROLLING THEREOF

(75) Inventors: Hajime Sato, Kasugai (JP); Syuichi Saito, Kasugai (JP); Akihiro Iwase, Kasugai (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/061,183

(22) Filed: Feb. 4, 2002

(65) Prior Publication Data

US 2002/0167350 A1 Nov. 14, 2002

(30) Foreign Application Priority Data

Apr. 5, 2001 (JP) ..... 2001-107131
Jun. 18, 2001 (JP) ..... 2001-182982

(51) Int. Cl.
*G05F 1/10* (2006.01)
*G05F 3/02* (2006.01)

(52) U.S. Cl. ..... 327/543

(58) Field of Classification Search ..... 327/530, 327/538, 540–541, 543, 544; 323/312, 315, 323/316

See application file for complete search history.

(56) References Cited

U.S. PATENT DOCUMENTS 5,408,172 A 4/1995 Tanimoto et al. ..... 323/273
5,467,032 A * 11/1995 Lee ..... 326/88
5,506,495 A 4/1996 Uchida ..... 323/315
5,675,280 A 10/1997 Nomura et al. ..... 327/538
5,696,465 A 12/1997 Ishizuka ..... 327/544
5,757,226 A 5/1998 Yamada et al. ..... 327/541
5,786,724 A * 7/1998 Teggatz ..... 327/534
5,903,513 A 5/1999 Itou ..... 365/233
5,910,924 A * 6/1999 Tanaka et al. ..... 365/226
5,986,293 A 11/1999 Suzuki et al. ..... 257/203
5,990,671 A 11/1999 Nagata ..... 323/313
5,994,886 A 11/1999 Shinozaki ..... 323/303
6,064,188 A 5/2000 Takashima et al. ..... 323/316
6,111,395 A * 8/2000 Hirade et al. ..... 323/273
6,191,615 B1 * 2/2001 Koga ..... 327/534
6,198,671 B1 * 3/2001 Aoyama et al. ..... 365/189.09

FOREIGN PATENT DOCUMENTS

EP 0 454 170 4/1991

(Continued)

OTHER PUBLICATIONS

Simple Regulator for Low Voltage, Low Power Loss Applications, IBM Technical Disclosure Bulletin, Aug. 1992, US, vol. No. 35, Issue No. 3, p. No. 94-95.*

(Continued)

*Primary Examiner*—Quan Tra
(74) *Attorney, Agent, or Firm*—Arent Fox PLLC

(57) ABSTRACT

A voltage generator circuit which is capable of preventing the generation of a through current in a transition to a power-down mode to reduce current consumption. The voltage generator circuit includes a voltage generator activated by a reference voltage to generate an output voltage. A reference voltage clamp circuit is coupled to the voltage generator for clamping the reference voltage to a first voltage in response to a power-down signal to deactivate the voltage generator. An output voltage clamp circuit is coupled to the voltage generator for clamping the output voltage to a second voltage. A control circuit is coupled to the output voltage clamp circuit for enabling the output voltage clamp circuit after the voltage generator is deactivated in response to the power-down signal.

13 Claims, 21 Drawing Sheets

FOREIGN PATENT DOCUMENTS

| | | |
|---|---|---|
| EP | 0 613 071 | 2/1994 |
| JP | 2-59806 | 2/1990 |
| JP | 2000-82951 | 3/2000 |
| JP | 2000-347755 | 12/2000 |

OTHER PUBLICATIONS

European Search Report dated Aug. 20, 2004 for EP 02251264.4-1239.

* cited by examiner

VOLTAGE GENERATOR CIRCUIT AND METHOD FOR CONTROLLING THEREOF

BACKGROUND OF THE INVENTION

The present invention relates to a voltage generator circuit, and more particularly, to a voltage generator circuit built in a semiconductor device.

A semiconductor device may be provided with a voltage generator circuit which receives an external supply voltage to generate an internal supply voltage that is supplied to internal circuits of the semiconductor device.

Employment of a step-down circuit in the voltage generator circuit can accommodate a reduction in gate breakdown and drain-source breakdown resulting from a reduction in power consumption of the internal circuits and miniaturization of transistors. In a semiconductor device intended for installation in a system that has a power-down mode, the operation of the voltage generator circuit is deactivated in the power-down mode to shut off a current consumed in the internal circuits.

FIG. 1 is a schematic circuit diagram of a voltage generator circuit 100 according to a first prior art example. The voltage generator circuit 100 functions as a step-down circuit which includes a plurality of N-channel MOS transistors. A step-down transistor Tr1, comprised of an N-channel MOS transistor, is provided with an external power supply (high potential power supply) Vcc at a drain, and a reference voltage Vg generated by a reference voltage generator circuit (not shown) at the gate.

The step-down transistor Tr1 has a source coupled to an internal circuit 1. When the reference voltage Vg is supplied to the gate of the transistor Tr1, the internal circuit 1 is supplied with an internal voltage (internal supply voltage) Vdd which is reduced by a threshold value Vthn of the transistor Tr1 from the voltage of the external power supply Vcc.

A capacitor C1 is coupled between the gate of the transistor Tr1 and an external power supply (low potential power supply) Vss. The capacitor C1 reduces coupling noise included in the reference voltage Vg in response to fluctuations in the internal voltage Vdd.

A reference voltage clamp transistor Tr2, comprised of an N-channel MOS transistor, is coupled between the gate of the transistor Tr1 and the external power supply Vss. The transistor Tr2 is supplied with a power-down signal pd at the gate. When the power-down signal pd rises to H level in a power-down mode, the transistor Tr2 is turned on to clamp the reference voltage Vg to the voltage of the external power supply Vss, causing the transistor Tr1 to turn off.

A capacitor C2 is coupled between the source of the transistor Tr1 (internal voltage Vdd) and the external power supply Vss. The capacitor C2 is used to stabilize the internal voltage Vdd. The capacitor C2 includes a parasitic capacitance of the internal circuit 1.

An internal voltage clamp transistor Tr3, comprised of an N-channel MOS transistor, is coupled between the source of the transistor Tr1 and the external power supply Vss. The transistor Tr3 is supplied with the power-down signal pd at the gate. When the power-down signal pd rises to H level, the transistor Tr3 is turned on with the transistor Tr1 remaining off, to clamp the internal voltage Vdd to the voltage of the external power supply Vss, as shown in FIG. 3. Such an operation shuts off the supply of the internal voltage Vdd in the power-down mode, so that the current consumption is prevented in the internal circuit 1.

In the voltage generator circuit 100, when the power-down signal pd rises to H level for a transition from a normal mode to the power-down mode, the transistors Tr2, Tr3 are turned on to reduce the reference voltage Vg and the internal voltage Vdd, as shown in FIG. 3. In this time, since the capacitances of the capacitor C1 and the transistor Tr1 are very large as compared with the driving capability of the transistor Tr2, the reference voltage Vg slowly goes down in accordance with the CR time constant in response to the transistor Tr2 when it turns on. In this situation, in a time period t1 until a potential difference between the reference voltage Vg and the internal voltage Vdd is reduced to the threshold value Vthn of the transistor Tr1 or smaller, the transistors Tr1, Tr3 are simultaneously turned on to cause a through current to flow from the external power supply Vcc to the external power supply Vss. The through current may cause a reduction in voltage of the external power supply Vcc, and a malfunction of the internal circuit 1.

Also, in the voltage generator circuit 100, even if a gate-to-source voltage Vgs of the step-down transistor Tr1 is at 0 V in the power-down mode, a sub-threshold current flows across the drain and source of the transistor Tr1 due to the physical characteristics of the transistor, and this sub-threshold current flows into the external power supply Vss through the transistor Tr3.

When Vgs=0 V, a sub-threshold current IL flowing into an N-channel MOS transistor is generally expressed by the following equation (1):

$$I_L = \frac{Io}{Wo} W \cdot 10^{-vtc/s}$$

where W is a channel width of the transistor; Vtc is a gate-to-source voltage when a constant drain-to-source current I0 begins to flow into the transistor having a channel width W0; and S is a tailing coefficient.

For example, a sub-threshold current ranging from several tens to several hundreds of microamperes (μA) flows into the step-down transistor Tr1 having a channel width ranging from several tens to several hundreds of thousands of micrometers (μm), causing increased current consumption in the power-down mode.

FIG. 2 is a schematic circuit diagram of a voltage generator circuit 200 according to a second prior art example. The voltage generator circuit 200 functions as a step-down circuit which includes a plurality of P-channel MOS transistors. A step-down transistor Tr4, comprised of a P-channel MOS transistor, is supplied with a voltage of an external power supply Vcc at a source, and a reference voltage Vg generated by a reference voltage generator circuit at the gate.

The reference voltage Vg is generated by the reference voltage generator circuit such that it rises as an internal voltage Vdd increases and falls as the internal voltage Vdd decreases. Also, the reference voltage Vg is generated such that the internal voltage Vdd is set at a voltage smaller than the voltage of the external power supply Vcc by a predetermined voltage.

The step-down transistor Tr4 has a drain coupled to an internal circuit 1. When the reference voltage Vg is supplied to the gate of the transistor Tr4, the internal circuit 1 is supplied with the internal voltage Vdd.

A reference voltage clamp transistor Tr5, comprised of a P-channel MOS transistor, is coupled between the gate of the transistor Tr4 and the external power supply Vcc. The transistor Tr5 is supplied with a power-down signal pd at the gate through an inverter circuit 2. When the power-down signal pd rises to H level in a power-down mode, the transistor Tr5 is turned on to clamp the reference voltage Vg to the voltage of the external voltage Vcc, causing the transistor Tr4 to turn off.

A capacitor C4 is coupled between the drain of the transistor Tr4 (internal voltage Vdd) and an external power supply Vss. The capacitor C4 is used to stabilize the internal voltage Vdd. The capacitor C4 includes a parasitic capacitance of the internal circuit 1.

An internal voltage clamp transistor Tr6, comprised of an N-channel MOS transistor, is coupled between the drain of the transistor Tr4 and the external power supply Vss. The transistor Tr6 is supplied with the power-down signal pd at the gate. When the power-down signal pd rises to H level, the transistor Tr6 is turned on with the transistor Tr4 remaining off, to clamp the internal voltage Vdd to the voltage of the external power supply Vss, as shown in FIG. 4. Such an operation shuts off the supply of the internal voltage Vdd in the power-down mode, so that the current consumption is prevented in the internal circuit 1.

In the voltage generator circuit 200, as the power-down signal pd rises to H level for a transition from a normal mode to the power-down mode, the transistors Tr5, Tr6 are turned on to increase the reference voltage Vg, causing the internal voltage Vdd to fall down, as shown in FIG. 4. In this event, since the capacitance of the transistor Tr4 is very large as compared with the driving capability of the transistor Tr5, the reference voltage Vg slowly rises in accordance with the CR time constant in response to the transistor Tr5 when it is turned on. Consequently, in a time period t2 until a potential difference between the reference voltage Vg and the voltage of the external power supply Vcc is reduced to a threshold value Vthp of the transistor Tr4 or less, the transistors Tr4, Tr6 are simultaneously turned on, causing a through current to flow from the external power supply Vcc to the external power supply Vss. Therefore, the through current may cause a reduction in voltage of the external power supply Vcc, and a malfunction of the internal circuit 1.

In the voltage generator circuits 100 and 200, if the transistors Tr2, Tr5 are increased in size to improve the current driving capabilities, the reference voltage Vg could be reduced or increased at a higher speed. However, if the transistors Tr2, Tr5 are increased in size so as to ensure load driving capabilities corresponding to the capacitor C1 and the capacitances of the transistors Tr1, Tr4, a resulting increase in circuit area would prevent higher integration.

Also, in the voltage generator circuit 200, even when the gate-to-source voltage Vgs of the step-down transistor Tr4 is at 0 V, the sub-threshold current flows into the transistor Tr4, causing an increase in current consumption.

For example, a voltage generator circuit 200 has been proposed for clamping the internal voltage Vdd to the voltage of the external power supply Vdd in the power-down mode. The voltage generator circuit 200 omits the transistor Tr6 of the step-down circuit of FIG. 2, and turns on the transistor Tr4 in the power-down mode to clamp the internal voltage Vdd to the voltage of the external power supply Vcc. This voltage generator circuit 200 suffers from an increase in current consumption due to a sub-threshold current flowing into a large number of N-channel MOS transistors in an internal circuit 1.

SUMMARY OF THE INVENTION

It is a first object of the present invention to provide a voltage generator circuit which is capable of preventing the generation of a through current in a transition to a power-down mode to reduce current consumption.

It is a second object of the present invention to provide a voltage generator circuit which is capable of reducing a sub-threshold current in a power-down mode to reduce current consumption.

In a first aspect of the invention, a voltage generator circuit is provided that includes a voltage generator activated by a reference voltage to generate an output voltage. A reference voltage clamp circuit is coupled to the voltage generator for clamping the reference voltage to a first voltage in response to a power-down signal to deactivate the voltage generator. An output voltage clamp circuit is coupled to the voltage generator for clamping the output voltage to a second voltage. A control circuit is connected to the output voltage clamp circuit for enabling the output voltage clamp circuit after the voltage generator is deactivated in response to the power-down signal.

In a second aspect of the present invention, a voltage generator circuit is provided that includes a voltage generator activated by a reference voltage to generate an output voltage by stepping down an external supply voltage. A reference voltage clamp circuit is coupled to the voltage generator for clamping the reference voltage to a first voltage in response to a power-down signal to deactivate the voltage generator. An output voltage clamp circuit is coupled to the voltage generator for clamping the output voltage to a second voltage. A control circuit is coupled to the output voltage clamp circuit for enabling the output voltage clamp circuit after generation of the output voltage by the voltage generator is stopped in response to the power-down signal.

In a third aspect of the present invention, a semiconductor device is provided that includes a voltage generator circuit including a voltage generator activated by a reference voltage to generate an internal voltage. A reference voltage clamp circuit is coupled to the voltage generator for clamping the reference voltage to a first voltage in response to a power-down signal to deactivate the voltage generator. An internal voltage clamp circuit is coupled to the voltage generator for clamping the internal voltage to a second voltage. A control circuit is coupled to the internal voltage clamp circuit for enabling the internal voltage clamp circuit after the voltage generator is deactivated in response to the power-down signal. An internal circuit is coupled to the voltage generator and the internal voltage clamp circuit, enabled by the internal voltage, and deactivated by the second voltage.

In a fourth aspect of the present invention, a semiconductor device is provided that includes a voltage generator circuit including a voltage generator activated by a reference voltage to reduce an external supply voltage to generate an internal voltage. A reference voltage clamp circuit is coupled to the voltage generator for clamping the reference voltage to a first voltage in response to a power-down signal to deactivate the voltage generator. An internal voltage clamp circuit is coupled to the voltage generator for clamping the internal voltage to a second voltage. A control circuit is coupled to the internal voltage clamp circuit for operating the internal voltage clamp circuit after generation of the internal voltage by the voltage generator is stopped in response to the power-down signal. An internal circuit is coupled to the voltage generator and the internal voltage clamp circuit, enabled by the internal voltage, and deactivated by the second voltage.

In a fifth aspect of the present invention, a method of controlling a voltage generator circuit is provided. The circuit includes a voltage generator activated by a reference voltage to generate an internal voltage which is supplied to an internal circuit. The method includes the steps of: clamping the reference voltage to a first voltage in response to a power-down signal to deactivate the voltage generator; and clamping the internal voltage to a second voltage to deactivate the internal circuit after the voltage generator is deactivated.

In a sixth aspect of the present invention, a voltage generator circuit is provided that includes a voltage generator activated by a reference voltage to generate an output voltage. A reference voltage clamp circuit is coupled to the voltage generator for clamping the reference voltage to a predetermined clamp voltage in response to a power-down signal to deactivate the voltage generator. A sub-threshold current reduction circuit reduces a sub-threshold current flowing into the voltage generator when the voltage generator is deactivated.

In a seventh aspect of the present invention, a semiconductor device is provided that includes a voltage generator circuit including a voltage generator activated by a reference voltage to generate an output voltage. A reference voltage clamp circuit is coupled to the voltage generator for clamping the reference voltage to a predetermined clamp voltage in response to a power-down signal to deactivate the voltage generator. A sub-threshold current reduction circuit reduces a sub-threshold current flowing into the voltage generator when the voltage generator is deactivated. An internal circuit is coupled to the voltage generator and enabled by the output voltage.

In an eighth aspect of the present invention, a method of controlling a voltage generator circuit having a voltage generator for generating an internal voltage supplied to an internal circuit is provided. The method includes the steps of: deactivating the voltage generator in response to a power-down signal; and setting the internal voltage of the voltage generator to a balance voltage at which a sub-threshold current flowing into the voltage generator balances a sub-threshold current flowing into the internal circuit when the voltage generator is deactivated.

In a ninth aspect of the present invention, a method of controlling a voltage generator circuit having a voltage generator comprised of a MOS transistor is provided. The method includes the steps of: deactivating the MOS transistor in response to a power-down signal; and supplying at least one of a gate and a back gate of the MOS transistor with a voltage at which a sub-threshold current can be shut off when the MOS transistor is deactivated.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
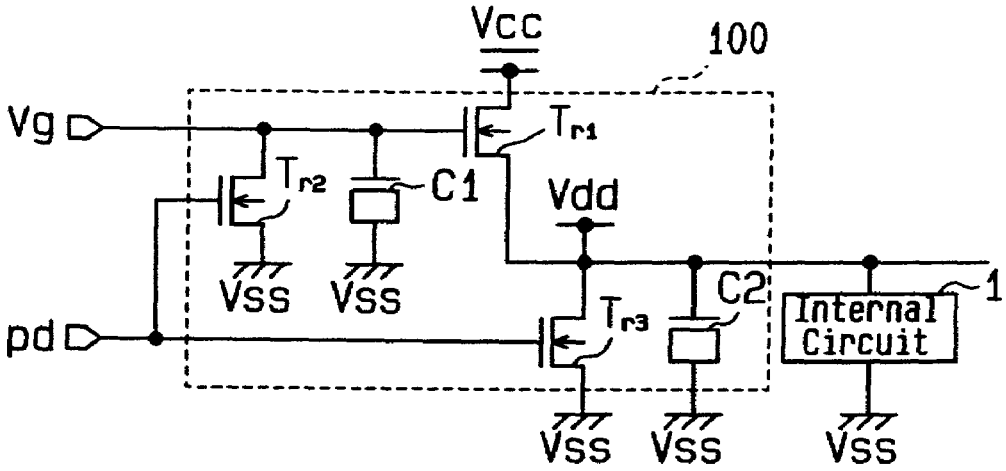
Fig.1 (Prior Art)
FIG. 1 is a schematic circuit diagram of a voltage generator circuit according to a first prior art example.

In the drawings, like numerals are used for like elements throughout.

Figure 5:
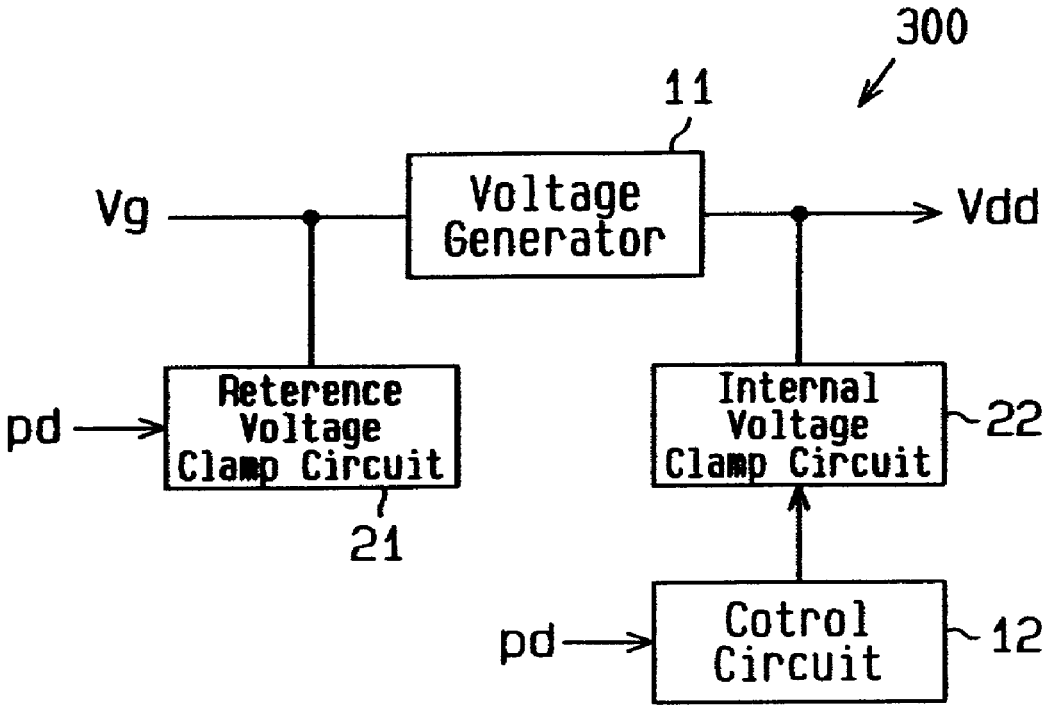
FIG. 5 is a schematic block diagram of a voltage generator circuit according to a first embodiment of the present invention.

FIG. 5 is a schematic block diagram of a voltage generator circuit 300 according to a first embodiment of the present invention. The voltage generator circuit 300 includes a voltage generator 11, a reference voltage clamp circuit 21, an internal voltage clamp circuit 22, and a control circuit 12. The voltage generator circuit 11 receives a reference voltage Vg and generates an internal voltage Vdd. The reference voltage clamp circuit 21 clamps the reference voltage Vg to a first voltage Vss for deactivating the voltage generator 11 in response to a power-down signal pd. The internal voltage clamp circuit 22 clamps the internal voltage Vdd to a second voltage (in this case, the first voltage Vss). The control circuit 12 activates the internal voltage clamp circuit 22 after the voltage generator 11 is deactivated in response to the power-down signal pd. Since the voltage generator 11 and the internal voltage clamp circuit 22 will never be activated simultaneously, a through current from an external power supply Vcc to an external power supply Vss is shut off.

Figure 6:
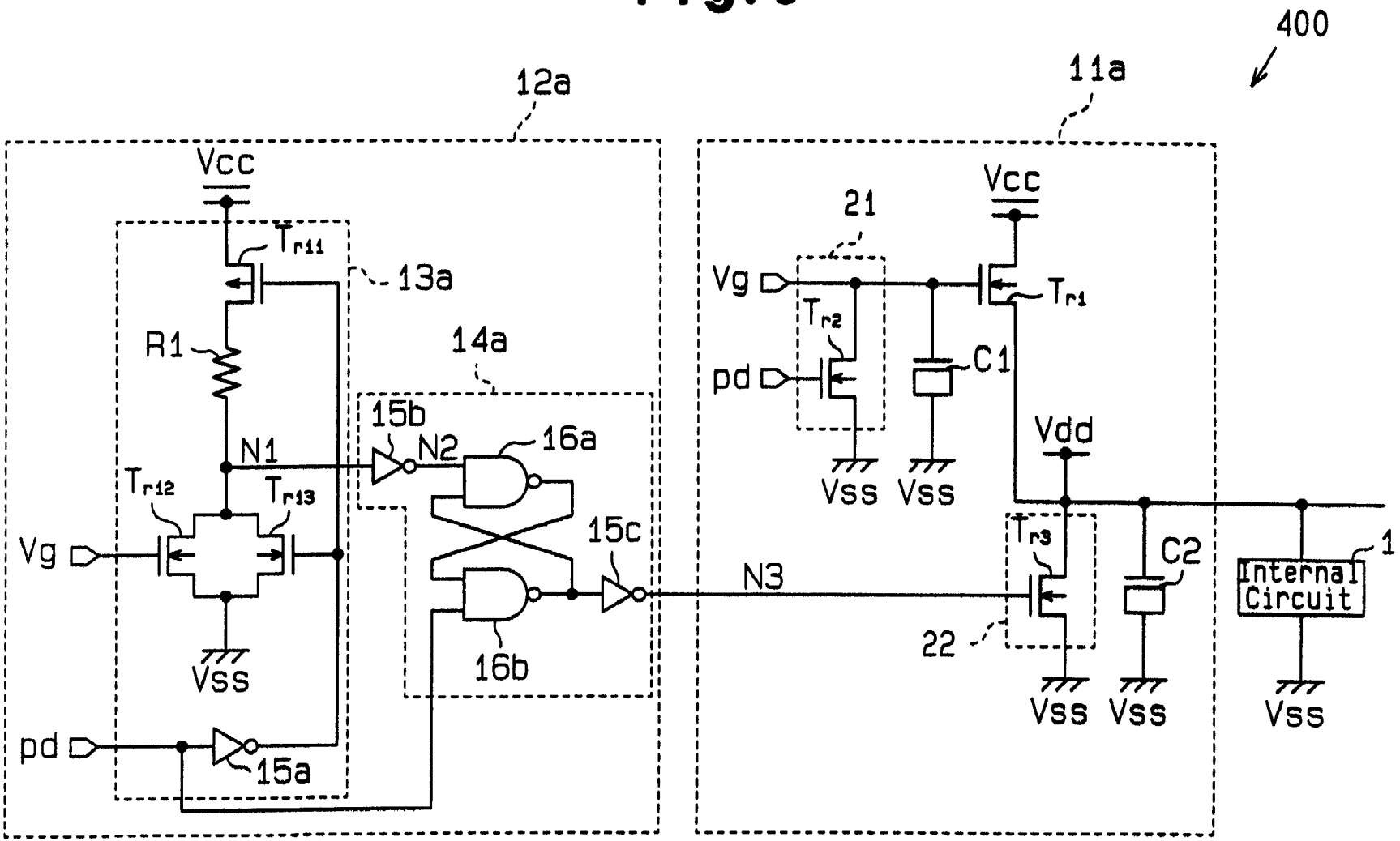
FIG. 6 is a schematic circuit diagram of a voltage generator circuit according to a second embodiment of the present invention.

FIG. 6 is a schematic circuit diagram of a voltage generator circuit 400 according to a second embodiment of the present invention. A semiconductor device includes a voltage generator circuit 400, and an internal circuit 1 coupled to the voltage generator circuit 400. The voltage generator circuit 400 includes a step-down circuit 11*a*, and a control circuit 12*a* for controlling the step-down circuit 11*a* in a power-down mode. Since the step-down circuit 11*a* is similar in configuration to the voltage generator circuit 100 in FIG. 1, the corresponding components are designated the same reference numerals. Here, a P-channel MOS transistor Tr11 corresponds to the voltage generator 11 of FIG. 5; P-channel MOS transistor Tr2 to the reference voltage clamp circuit 21 of FIG. 5; and P-channel MOS transistor Tr3 to the internal voltage clamp circuit 22 of FIG. 5.

The control circuit 12*a* includes a reference voltage detector circuit 13*a*, and a clamp signal generator circuit 14*a*. In the reference voltage detector circuit 13*a*, the P-channel MOS transistor Tr11 has a source coupled to an external power supply Vcc, and a drain coupled to drains of N channel MOS transistors Tr12, Tr13 through a resistor R1. The resistor R1 has a sufficiently large resistance value with respect to the ON-resistance of the transistor Tr12.

The transistors Tr11, Tr13 are supplied with a power-down signal pd at their gates through an inverter circuit 15*a*. The transistor Tr12 is supplied with a reference voltage Vg at the gate.

In the reference voltage detector circuit 13*a*, when the power-down signal pd is at L level, the transistor Tr11 is turned off, while the transistor Tr13 is turned on. Therefore, voltages at drains of the transistors Tr12, Tr13 (node N1) fall to L level, irrespective of the reference voltage Vg.

When the power-down signal pd rises to H level, the transistor Tr11 is turned on and the transistor Tr12 is also turned on if the reference voltage Vg is greater than a voltage of an external power supply Vss by a threshold value Vthn of the transistor Tr12. Therefore, the voltage at the node N1 falls to L level.

When the power-down signal pd rises to H level and the reference voltage Vg falls to L level, the transistor Tr11 is turned on, while the transistors Tr12, Tr13 are turned off, causing the voltage at the node N1 to rise to H level.

The voltage signal at the node N1 is supplied to an inverter circuit 15*b*, and an inverted voltage signal is supplied from an output terminal (node N2) of the inverter circuit 5*b* to the clamp signal generator circuit 14*a*.

The clamp signal generator circuit 14*a* includes NAND circuits 16*a*, 16*b*, and an inverter circuit 15*c*. An inverted voltage signal of the inverter circuit 15*b* is supplied to a first input terminal of the NAND circuit 16*a*. An output signal of the NAND circuit 16*a* is supplied to a first input terminal of the NAND circuit 16*b*, and the power-down signal pd is supplied to a second input terminal of the NAND circuit 16*b*.

An output signal of the NAND circuit 16*b* is supplied to a second input terminal of the NAND circuit 16*a* and also to the inverter circuit 15*c*. An inverted output signal is supplied from an output terminal (node N3) of the inverter circuit 15*c* to the gate of an internal voltage clamp transistor Tr3 of the step-down circuit 11*a*.

When the power-down signal pd is at L level, the NAND circuit 16*b* outputs an H-level signal, so that a voltage at the node N3 is set to L level to turn off the transistor Tr3.

When the power-down signal pd rises to H level and the reference voltage Vg falls to L level, the transistor Tr11 is turned on, while the transistors Tr12, Tr13 are turned off, causing the voltage at the node N1 to rise to H level.

When the voltage at the node N1 rises to H level, the NAND circuit 16*b* is supplied with two H-level signals, causing the NAND circuit 16*b* to output an L-level signal, thereby setting the voltage at the node N3 to H level to turn on the transistor Tr3.

Figure 7:
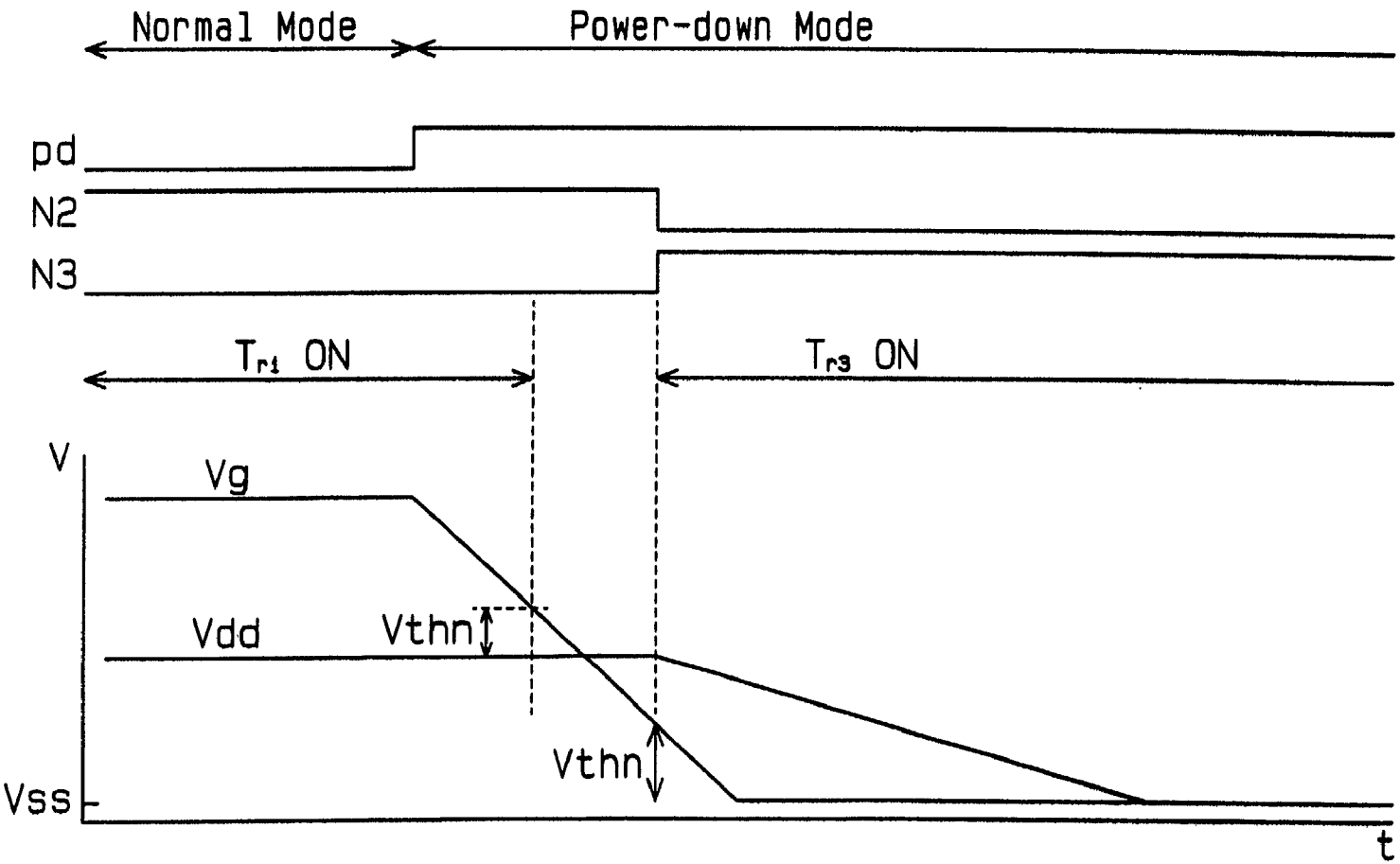
FIG. 7 is a waveform chart showing the operation of the voltage generator circuit of FIG. 6.

Next, the operation of the voltage generator circuit 300 will be described with reference to FIG. 7.

When the power-down signal pd is at L level in a normal mode, the transistor Tr2 is turned off, the controller 12*a* sets the voltage at the node N3 to L level, and the transistor Tr3 is turned off in the step-down circuit 11*a*. Therefore, the step-down circuit 11*a* receives the reference voltage Vg, and supplies an internal voltage Vdd to the internal circuit 1.

When the operation mode goes to the power-down mode from the normal mode, the supply of the reference voltage Vg is stopped, causing the power-down signal pd to rise to H level. In response, in the step-down circuit 11*a*, the transistor Tr2 is turned on to discharge an accumulated charge on the capacitor C1, causing a gradual decrease in the reference voltage Vg supplied to the gate of a transistor Tr1. When a potential difference between the reference voltage Vg and the internal voltage Vdd is equal to or smaller than a threshold value Vthn of the transistor, the transistor Tr1 is turned off.

In the reference voltage detector circuit 13*a*, the transistor Tr11 is turned on, while the transistor Tr13 is turned off. In this event, when the reference voltage Vg is greater than the voltage of the external power supply Vss by a threshold value Vthn of the transistor Tr12, the transistor Tr12 is maintained in an ON-state, the voltage at the node N1 is maintained at L level, and the voltage at the node N2 is maintained at H level. Thus, the voltage at the Node N3 is maintained at L level, causing the transistor Tr3 to remain off.

Next, when the potential difference between the reference voltage Vg and the external power supply Vss is equal to or smaller than the threshold value Vthn of the transistor Tr12, the transistor Tr12 is turned off, causing the voltage at the node N1 to rise to H level and the voltage at the node N2 to fall to L level. Consequently, the NAND circuit 16*b* is supplied with two H-level signals, causing the voltage at the node N3 to rise to H level to turn on the transistor Tr3. Then, the ON-operation of the transistor Tr3 causes the internal voltage Vdd to fall to the voltage of the external power supply Vss.

The internal voltage generator circuit 400 according to the second embodiment has the following advantages:

(1) In the power-down mode, the transistor Tr1 is turned off while the transistor Tr3 is turned on, so that the step-down circuit 11*a* reduces the internal voltage Vdd to the voltage of the external power supply Vss. Thus, in the power-down mode, useless current consumption is saved in the internal circuit 1.

(2) When the operation mode goes to the power-down mode from the normal mode, the control circuit 12*a* turns on the transistor Tr3 after the transistor Tr1 is turned off. Therefore, a through current from the external power supply Vcc to the external power supply Vss is shut off in the step-down circuit 11*a*.

(3) In the normal mode, the reference voltage detector circuit 13*a* is deactivated, so that the current consumed by the reference voltage detector circuit 13*a* is prevented.

Figure 8:
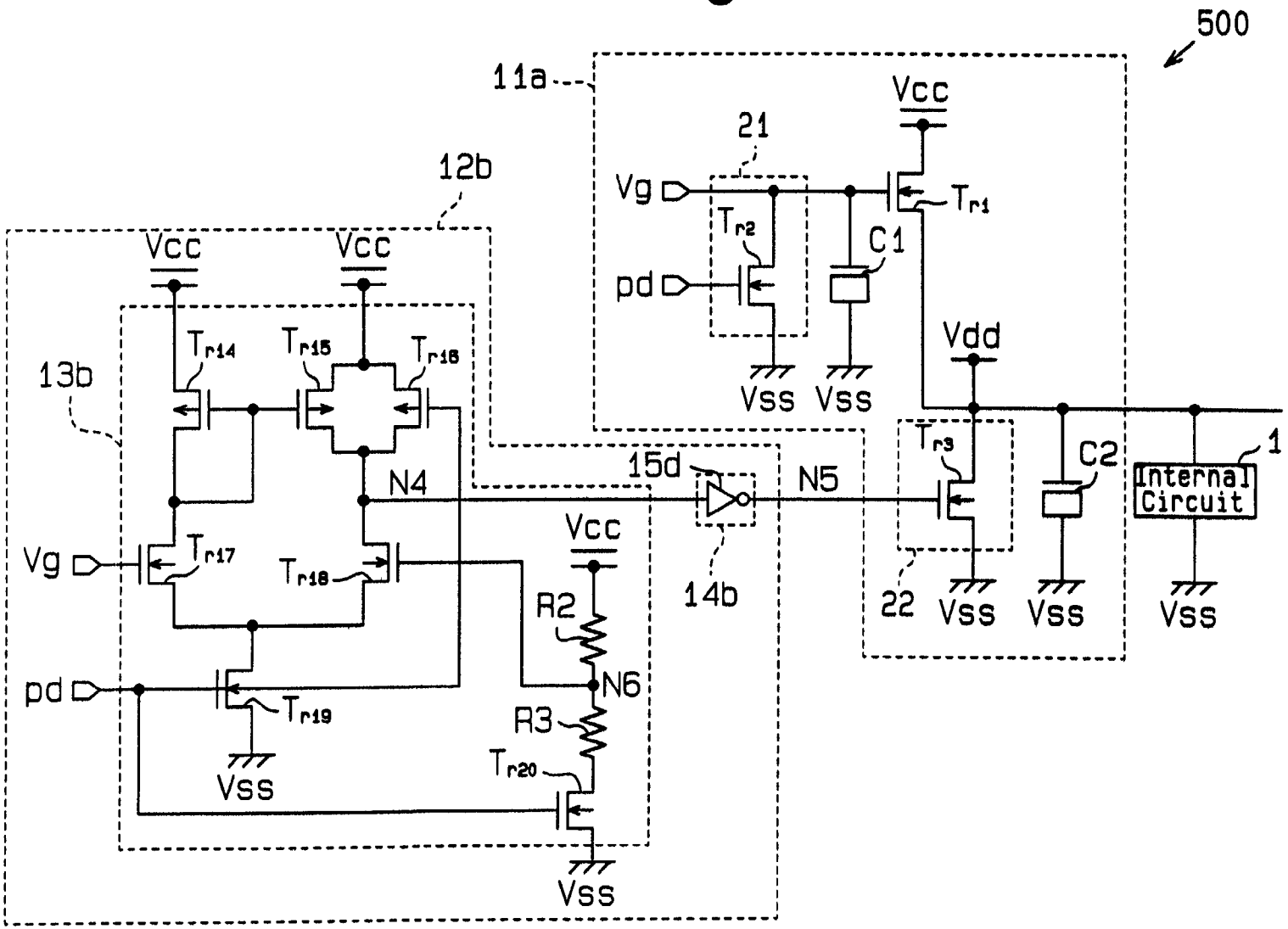
FIG. 8 is a schematic circuit diagram of a voltage generator circuit according to a third embodiment of the present invention.

FIG. 8 is a schematic circuit diagram of a voltage generator circuit 500 according to a third embodiment of the present invention. The voltage generator circuit 500 includes a control circuit 12*b*, and a step-down circuit 11*a*. The step-down circuit 11*a* is identical in configuration to that of the second embodiment.

The control circuit 12*b* includes a reference voltage detector circuit 13*b*, and a clamp signal generator circuit 14*b*. The reference voltage detector circuit 13*b* includes a differential amplifier. P-channel MOS transistors Tr14, Tr15, Tr16 of the differential amplifier have their sources coupled to an external power supply Vcc. The transistors Tr14, Tr15 have their gates coupled to each other, and also coupled to a drain of the transistor Tr14. The drain of the transistor Tr14 is coupled to a drain of an N-channel MOS transistor Tr17.

The transistors Tr15, Tr16 have their drains coupled to a drain (node N4) of an N-channel MOS transistor Tr18. The transistors Tr17, Tr18 have their sources coupled to an external power supply Vss through an N-channel MOS transistor Tr19.

The transistor Tr17 is supplied with a reference voltage Vg at the gate, while the transistors Tr16, Tr19 are supplied with a power-down signal pd at their gates.

A resistor R2, a resistor R3, and a transistor Tr20 are coupled in series between the external power supply Vcc and the external power supply Vss. The transistor Tr18 has a gate coupled to a node N6 between the resistor R2 and the resistor R3. In other words, the gate of the transistor Tr18 is coupled to the external power supply Vcc via the resistor R2 and also coupled to the external power supply Vss via the resistor R3 and the N-channel MOS transistor Tr20. The transistor Tr20 is supplied with the power-down signal pd at the gate.

When the power-down signal pd rises to H level to turn on the transistor Tr20, the transistor Tr18 is supplied at its gate with a voltage generated by dividing a potential difference between the voltage of the external power supply Vcc and the voltage of the external power supply Vss by the resistors R2, R3. The divided voltage is substantially set to a threshold value Vthn of the transistor Tr17.

The Node N4 between the transistors Tr15, Tr16 and transistor Tr18 is coupled to the gate of a transistor Tr3 via an inverter circuit 15*d*. The inverter circuit 15*d* forms a clamp signal generator circuit 14*b*. In other words, the inverter circuit 15*d* receives a voltage signal at the node N4, and supplies an inverted voltage signal from an output terminal (node N5) to the gate of the transistor Tr3 of the step-down circuit 11.

Figure 9:
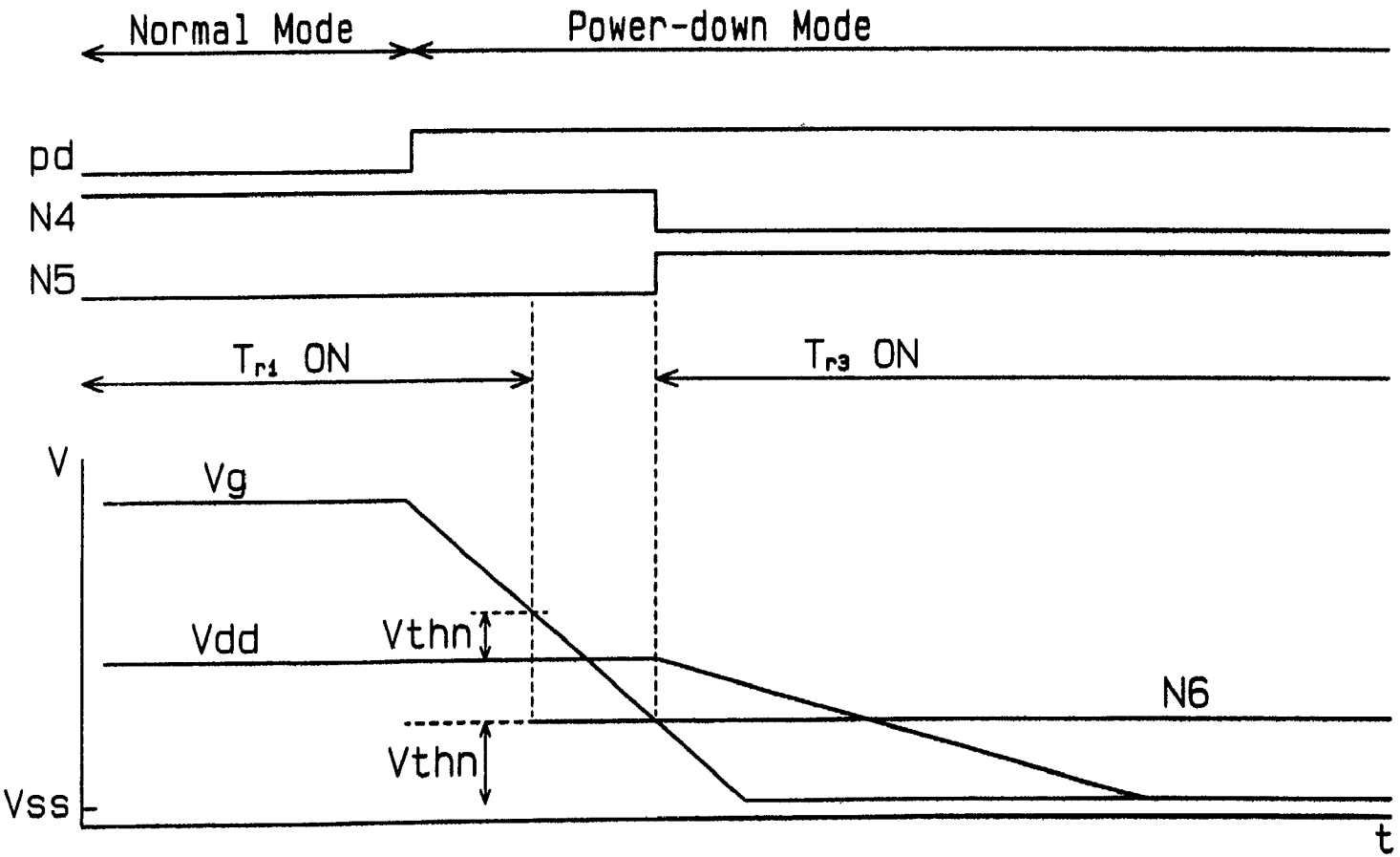
FIG. 9 is a waveform chart showing the operation of the voltage generator circuit of FIG. 8.

Next, the operation of the voltage generator circuit 500 will be described with reference to FIG. 9.

When the power-down signal pd is at L level in the normal mode, the transistor Tr2 is turned off in the step-down circuit 11*a*. In the reference voltage detector circuit 13*b*, the transistor Tr16 is turned on by the power-down signal pd at L level to set the voltage at the node N4 to H level. Consequently, the voltage at the node N5 is set to L level to turn off the transistor Tr3, and the step-down circuit 11*a* receives the reference voltage Vg and supplies the internal voltage Vdd to the internal circuit 1.

When the operation mode goes to the power-down mode from the normal mode, the supply of the reference voltage Vg is stopped, causing the power down signal pd to rise to H level. In response, in the step-down circuit 11*a*, the transistor Tr2 is turned on to discharge an accumulated charge on a capacitor C1, causing a gradual decrease in the reference voltage Vg supplied to the gate of the transistor Tr1. When a potential difference between the reference voltage Vg and the internal voltage Vdd is equal to or smaller than a threshold value Vthn of the transistor Tr1, the transistor Tr1 is turned off.

In the reference voltage detector circuit 13*b*, the transistor Tr16 is turned off by the power-down signal pd at H level, while the transistors Tr19, Tr20 are turned on. Consequently, the reference voltage detector circuit 13*b* is activated, and a constant voltage is generated at the node N6.

Here, when the reference voltage Vg is greater than the voltage at the node N6, the transistor Tr17 is maintained in an ON-state, the node N4 is maintained at H level, and the node N5 is maintained at L level. Therefore, the transistor Tr3 remains off.

When the reference voltage Vg becomes smaller than the voltage at the node N6, the transistor Tr17 is turned off, and the transistor Tr 18 is turned on, causing the voltage at the node N4 to fall to L level. In this way, the voltage at the node N5 rises to H level to turn on the transistor Tr3. The ON-operation of the Tr3 results in the internal voltage Vdd falling to the voltage of the external power supply Vss.

The internal voltage generator circuit 500 of the third embodiment has the following advantage in addition to similar advantages to those of the second embodiment.

Since the reference voltage detector circuit 13*b* is deactivated in the normal operation mode, an increase in the current consumption is prevented in the normal operation mode.

Figure 10:
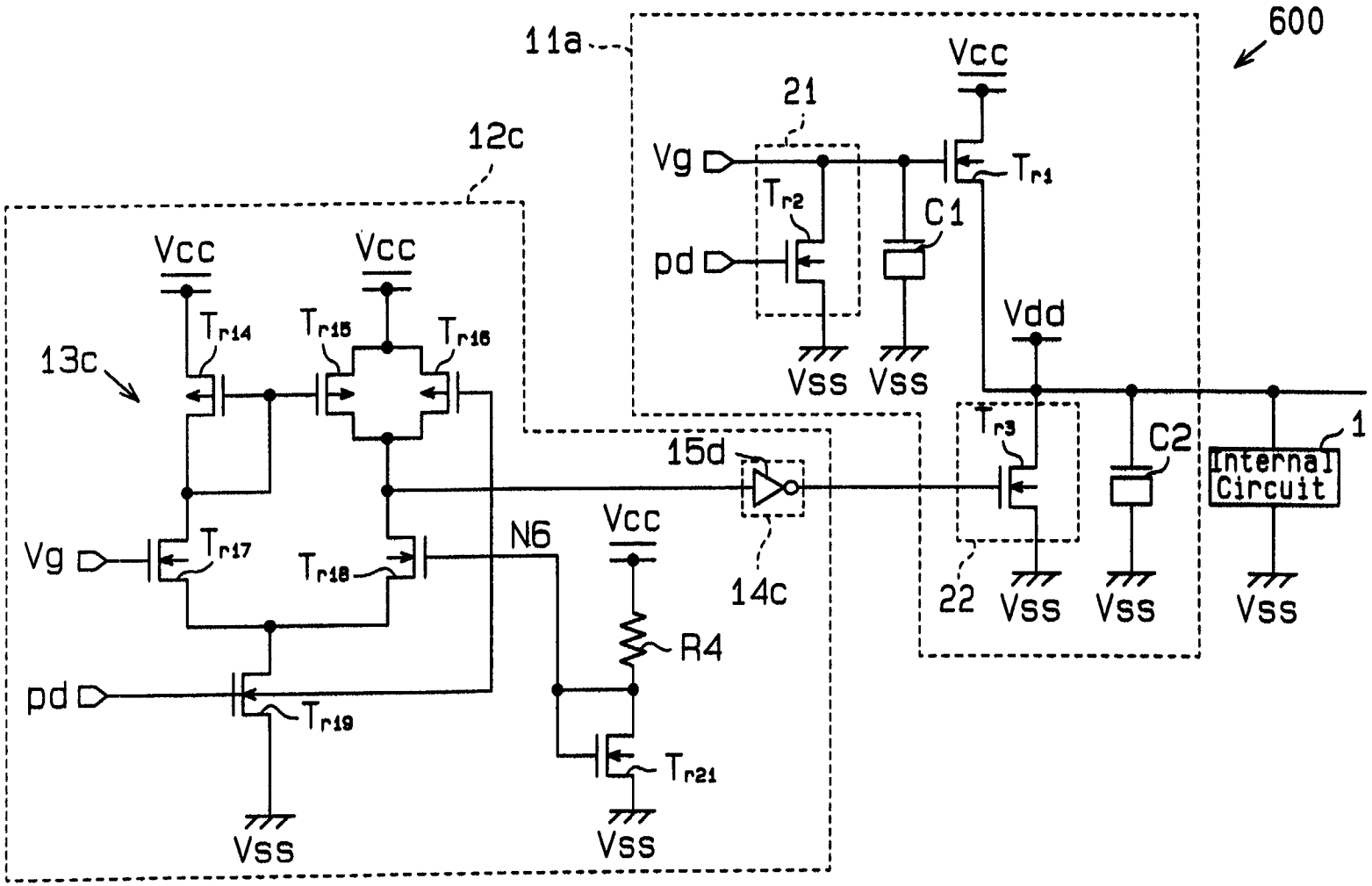
FIG. 10 is a schematic circuit diagram of a voltage generator circuit according to a fourth embodiment of the present invention.

FIG. 10 is a schematic circuit diagram of a voltage generator circuit 600 according to a fourth embodiment of the present invention. A control circuit 12*c* of the fourth embodiment has a reference voltage detector circuit 13*c* which includes a transistor Tr18 that has a gate (node N6) coupled to the external power supply Vcc via a resistor R4, and also coupled to the external power supply Vss via a diode-connected N-channel MOS transistor Tr21. The rest of the configuration in the reference voltage detector circuit 13*c* and the clamp signal generator circuit 14*c* are the same as those in the third embodiment.

When the external power supplies Vcc, Vss are switched on, the node N6 is normally set at a voltage greater than the external power supply Vss by a threshold value Vthn of the transistor Tr21. Therefore, the voltage generator circuit 600 of the fourth embodiment operates in a manner similar to the third embodiment.

Figure 2:
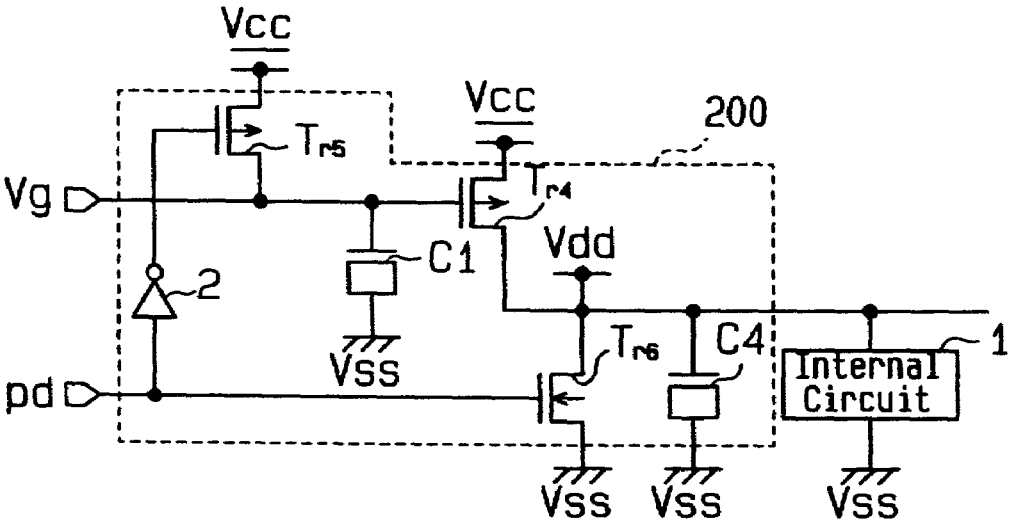
Fig.2 (Prior Art)
FIG. 2 is a schematic circuit diagram of a voltage generator circuit according to a second prior art example.
Figure 3:
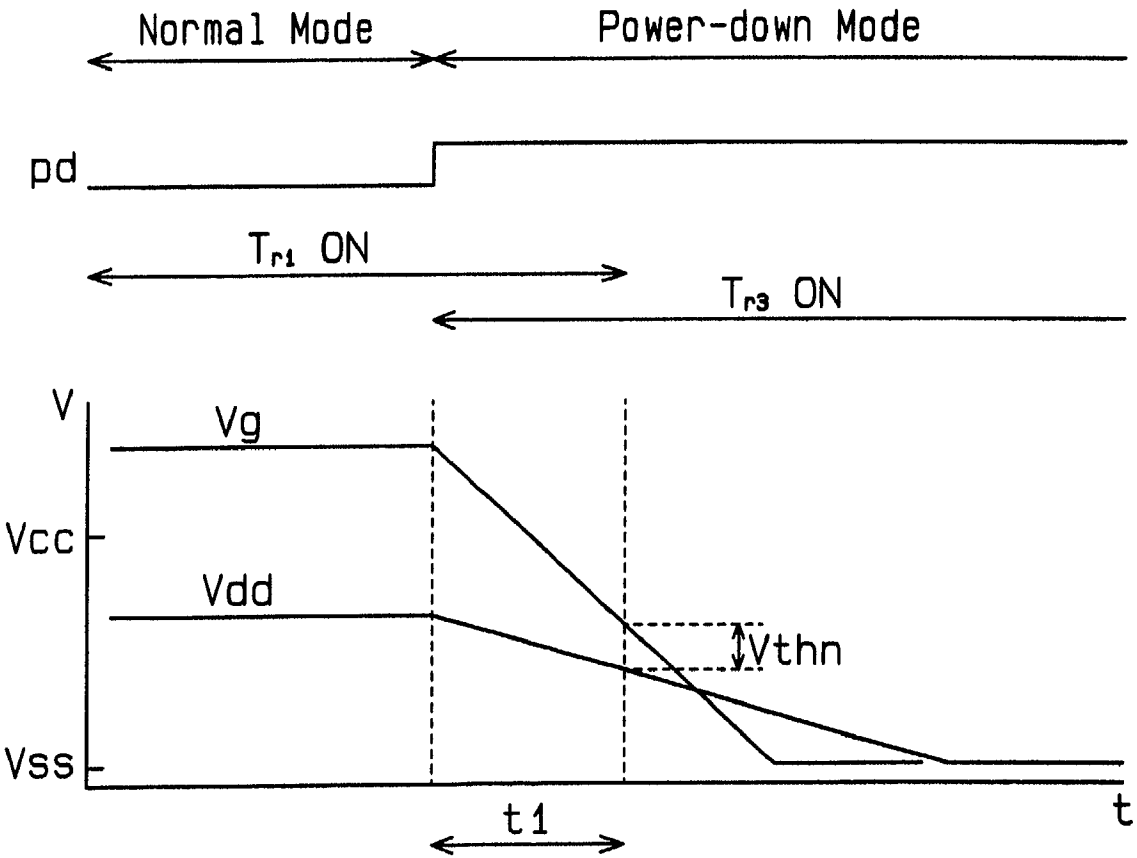
Fig.3(Prior Art)
FIG. 3 is a waveform chart showing the operation of the voltage generator circuit of FIG. 1.
Figure 4:
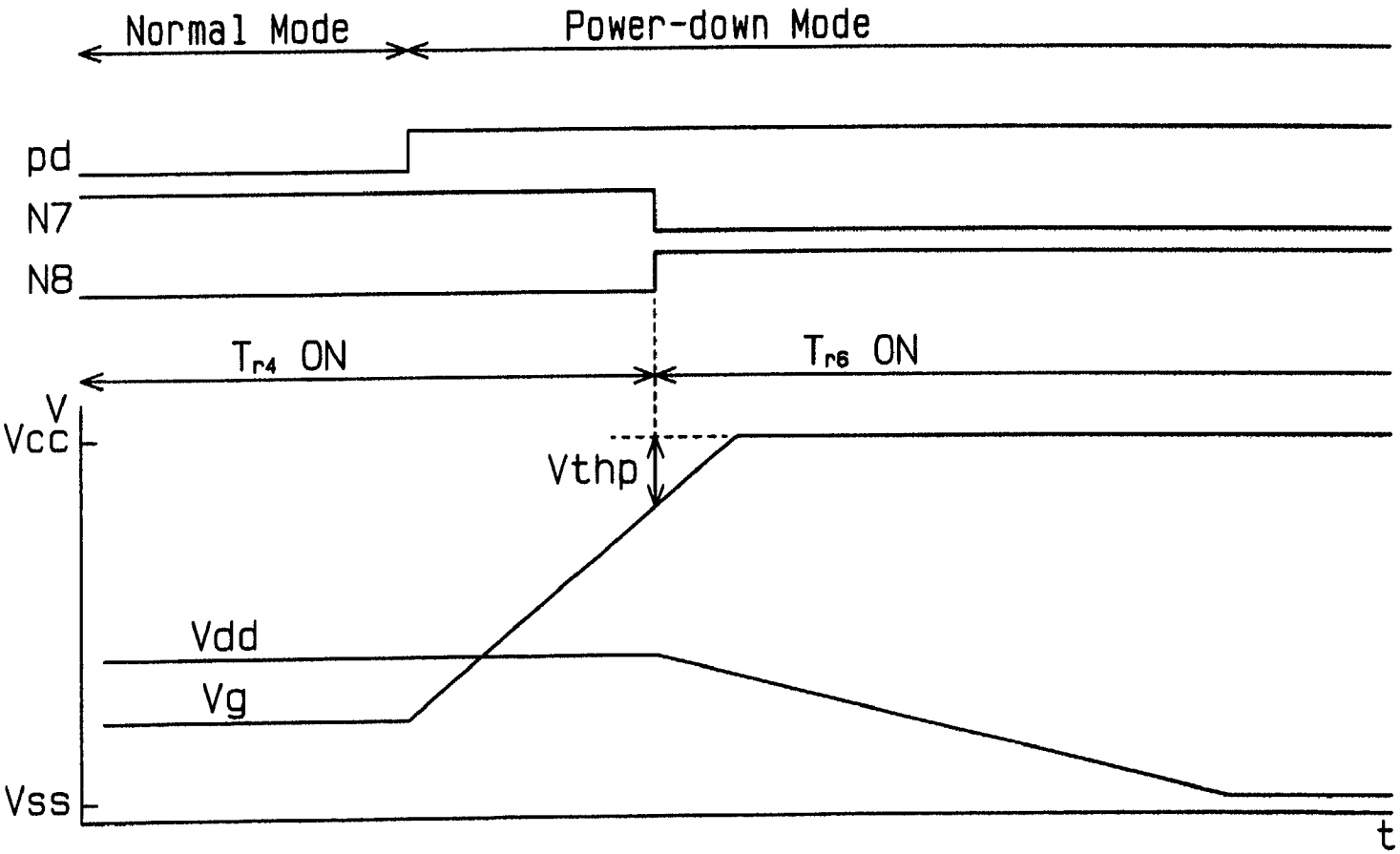
Fig.4(Prior Art)
FIG. 4 is a waveform chart showing the operation of the voltage generator circuit of FIG. 2.
Figure 11:
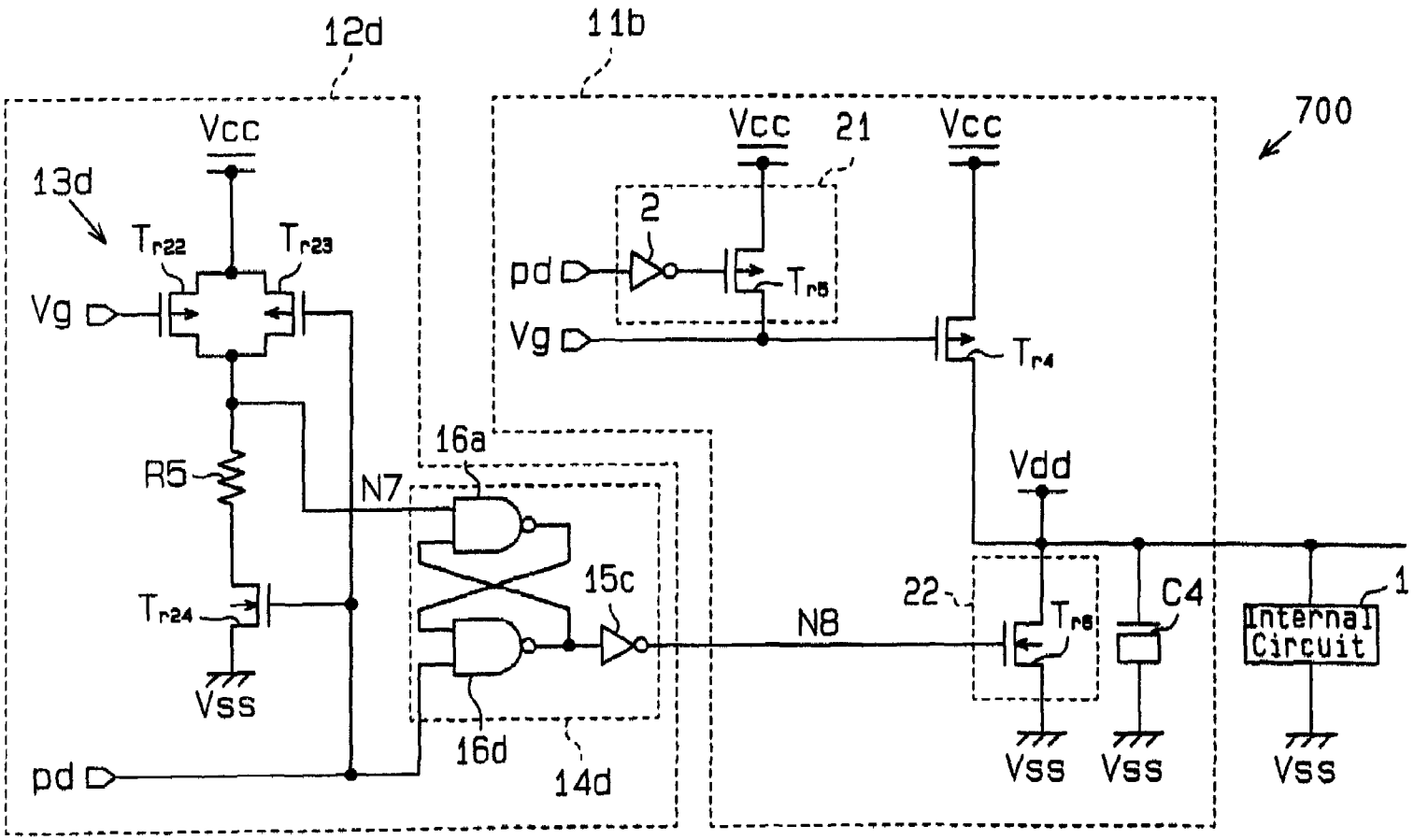
FIG. 11 is a schematic circuit diagram of a voltage generator circuit according to a fifth embodiment of the present invention.

FIG. 11 is a schematic circuit diagram of a voltage generator circuit 700 according to a fifth embodiment of the present invention. A step-down circuit 11*b* of the seventh embodiment is identical in configuration to the step-down circuit 200 of FIG. 2. The voltage generator circuit 700 includes a control circuit 12*d*. The control circuit 12*d* includes a reference voltage detector circuit 13*d* and a clamp signal generator circuit 14*d*. Here, an N-channel MOS transistor Tr4 corresponds to the voltage generator 11 of FIG. 5; an N-channel MOS transistor Tr5 and an inverter 2 correspond to the reference voltage clamp circuit 21 of FIG. 5; and an N-channel MOS transistor Tr6 corresponds to the internal voltage clamp circuit 22 of FIG. 5.

In the reference voltage detector circuit 13*d*, P-channel MOS transistors Tr22, Tr23 have their sources coupled to the external voltage Vcc, and their drains coupled to a drain of an N-channel MOS transistor Tr24 via a resistor R5. The transistor Tr24 has a source coupled to the external power supply Vss. The resistor R5 has a sufficiently high resistance value as compared with the ON-resistance of the transistor Tr24.

The transistors Tr23, Tr24 are supplied with a power-down signal pd at their gates. The transistor Tr22 is supplied with a reference voltage Vg at its gate.

In the reference voltage detector circuit 13*d*, when the power-down signal pd is at L level, the transistor Tr24 is turned off, while the transistor Tr23 is turned on. Therefore, a voltage at drains of the transistors Tr22, Tr23 (node N7) rises to H level irrespective of the reference voltage Vg.

When the power-down signal pd rises to H level, the transistor Tr24 is turned on, and the transistor Tr22 is also turned on, causing the node N7 to rise to H level if a potential difference between the reference voltage Vg and the voltage of the external power supply Vcc is equal to or smaller than a threshold value Vthp of the transistor Tr22.

When the power-down signal pd rises to H level, the transistor Tr24 is turned on, while the transistors Tr22, Tr23 are turned off, causing the node N7 to fall to L level if the potential difference between the reference voltage Vg and the voltage of the external power supply Vcc is equal to or smaller than a threshold value Vthp of the transistor Tr22.

The clamp signal generator circuit 14*d* omits the inverter circuit 15*b* in the input stage of the clamp signal generator circuit 14*a* of the second embodiment. The clamp signal generator circuit 14*d* is supplied with a voltage signal at the node N7 and the power-down signal pd. An output signal is supplied from the output terminal (node N8) of the clamp signal generator circuit 14*d* (inverter 15*c*) to the gate of the transistor Tr6.

Figure 12:
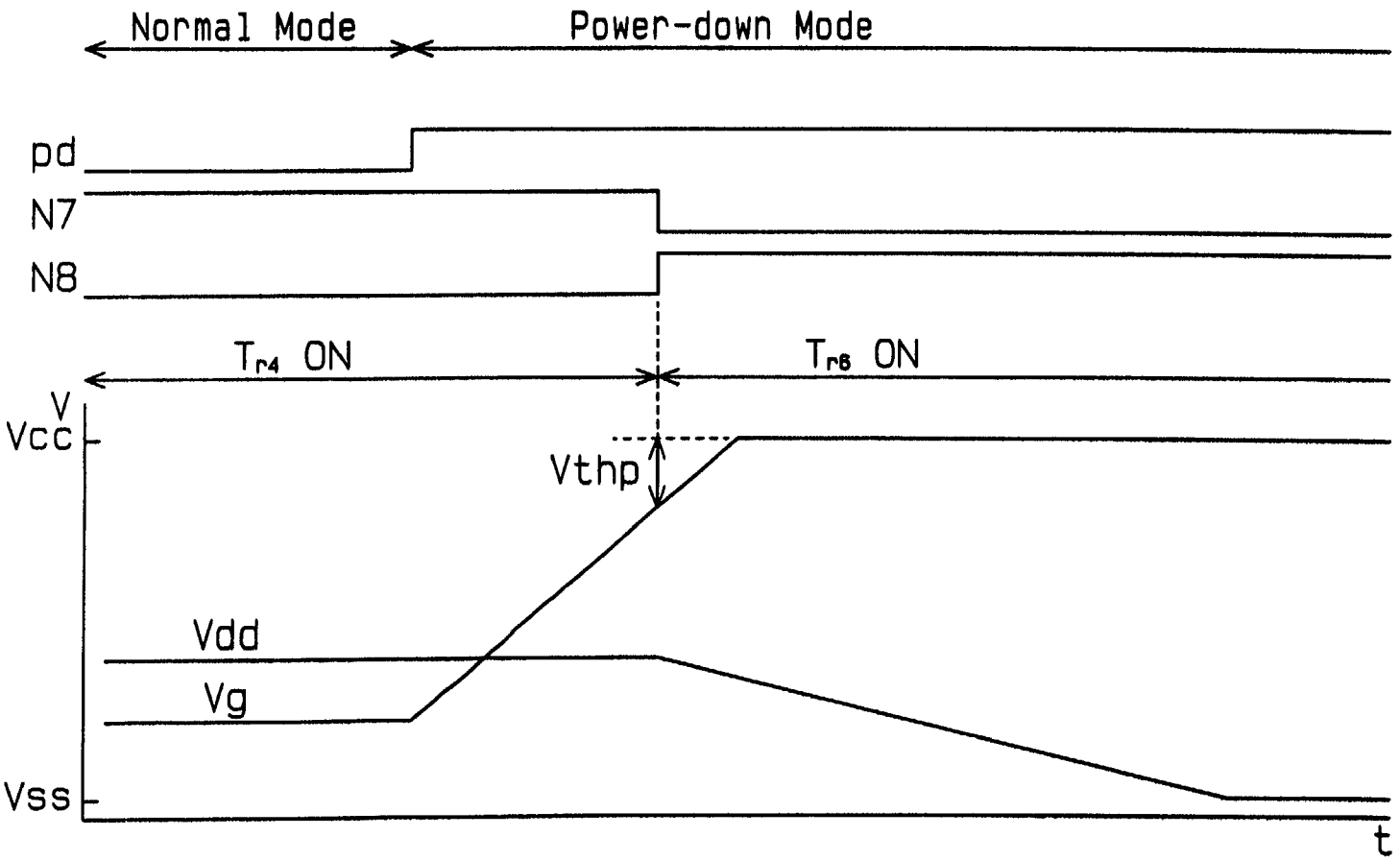
FIG. 12 is a waveform chart showing the operation of the voltage generator circuit of FIG. 11.

Next, the operation of the voltage generator circuit 700 according to the fifth embodiment of the present invention will be described with reference to FIG. 12. When the power-down signal pd is at L level in the normal mode, the transistor Tr5 is turned off in the step-down circuit 11*b*. Also, the voltage at the node N8 of the clamp signal generator circuit 14*d* is maintained at L level to turn off the transistor Tr6. The step-down circuit 11*b* receives the reference voltage Vg, and supplies the internal voltage Vdd to the internal circuit 1.

When the operation mode goes to the power-down mode from the normal mode, the supply of the reference voltage Vg is stopped, and the power-down signal pd rises to H level. In response, the transistor Tr5 is turned on in the step-down circuit 11*b*, causing a gradual increase in the reference voltage Vg supplied to the gate of the transistor Tr4. When the potential difference between the reference voltage Vg and the voltage of the external power supply Vcc is equal to or smaller than the threshold value Vthp of the transistor Tr4, the transistor Tr4 is turned off. In the reference voltage detector circuit 13*d*, the power-down signal at H level causes the transistor Tr24 to turn on and the transistor Tr23 to turn off. In this event, if the reference voltage Vg is smaller than the voltage of the external power supply Vcc by the threshold value Vthp of the transistor Tr22, the transistor Tr22 is maintained in an ON-state, and the node N7 is maintained at H level. Therefore, the node N8 is maintained at L level, so that the transistor Tr6 is maintained in OFF-state.

When the potential difference between the reference voltage Vg and the voltage of the external power supply Vcc is reduced to the threshold value Vthp of the transistor Tr22, the transistor Tr22 is turned off, causing the voltage at the node N7 to fall to L level, the voltage at the node N8 to rise to H level, and the transistor Tr6 to turn on. The ON-operation of the transistor Tr6 causes the internal voltage Vdd to fall to the voltage of the external power supply Vss.

The internal voltage generator circuit 700 of the fifth embodiment has the same advantages as the internal voltage generator circuit 400 of the second embodiment.

Figure 13:
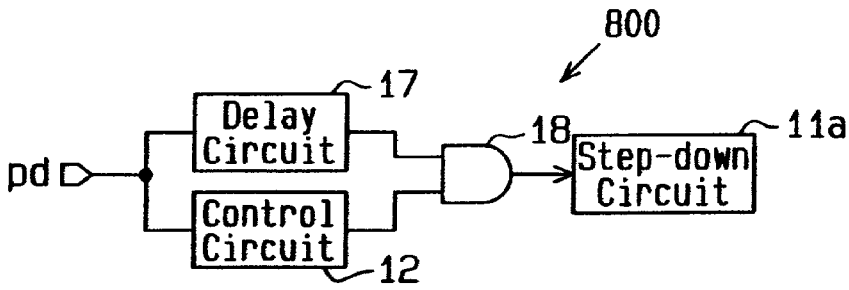
FIG. 13 is a schematic block diagram of a voltage generator circuit according to a sixth embodiment of the present invention.

FIG. 13 is a schematic block diagram of a voltage generator circuit 800 according to a sixth embodiment of the present invention. The voltage generator circuit 800 includes a control circuit 12, a delay circuit 17, and a step-down circuit 11*a* (or a step-down circuit 11*b*). A power-down signal pd is supplied to the control circuit 12 and the delay circuit 17.

The control circuit 12 may be any of the control circuits 12*a* to 12*d* in the second through fifth embodiments, and an output signal of the control circuit 12 is supplied to a first input terminal of an AND circuit 18. The delay circuit 17 delays the power-down signal pd by a predetermined time to generate a delayed power-down signal pd. The delayed power-down signal pd is supplied to a second input terminal of the AND circuit 18. An output signal of the AND circuit 18 is supplied to the gate of an internal voltage clamp transistor of the step-down circuit 11*a* (or the step-down circuit 11*b*).

When the operation mode goes to the power-down mode from the normal operation mode to the power-down mode, the power-down signal pd rises to H level. When output signals of the control circuit 12 and the delay circuit 17 both rise to H level after the power-down signal pd has risen to H level, the internal voltage clamp transistor is turned on by the output signal of the AND circuit 18. Thus, by appropriately setting the delay time of the delay circuit 17, the generation of a through current can be prevented without fail in the step-down circuit 11*a* (11*b*). Also, the internal voltage clamp transistor may be turned on only by the output signal of the delay circuit 17.

Figure 14:
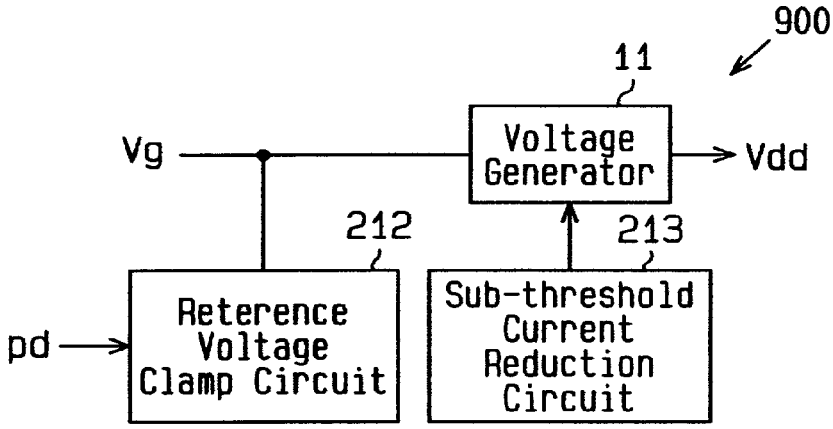
FIG. 14 is a schematic block diagram of a voltage generator circuit according to a seventh embodiment of the present invention.

FIG. 14 is a schematic block diagram of a voltage generator circuit 900 according to a seventh embodiment of the present invention. The voltage generator circuit 900 includes a voltage generator 11, a reference voltage clamping circuit 212, and a sub-threshold current reduction circuit 213. The voltage generator circuit 11 generates an internal voltage Vdd in response to a reference voltage Vg. The reference voltage clamping circuit 212 clamps the reference voltage Vg to a predetermined voltage in response to a power-down signal pd to deactivate the voltage generator 11. The sub-threshold current reduction circuit 213 prevents generation of sub-threshold voltage when the voltage generator 11 is deactivated.

Figure 15:
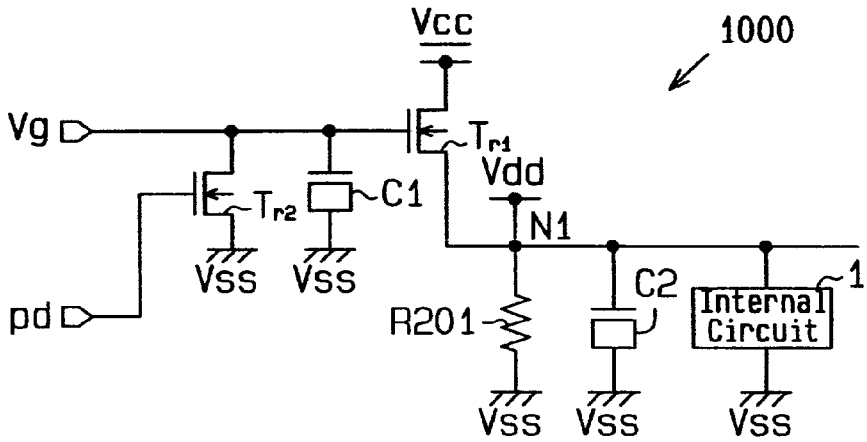
FIG. 15 is a schematic circuit diagram of a voltage generator circuit according to an eighth embodiment of the present invention.

FIG. 15 is a schematic circuit diagram of a voltage generator circuit 1000 according to an eighth embodiment of the present invention. The voltage generator circuit 1000 comprises a resistor R201 in place of the transistor Tr3 of the step-down circuit 100 of FIG. 1. The resistor R201 is coupled between the source of the transistor Tr1 (the output node N1 of an internal voltage Vdd) and the external power supply Vss. The resistance value of the resistor R201 is set at $10^{10}$ Ω or greater, i.e., 10 GΩ or greater.

Next, the operation of the voltage generator circuit 1000 will be described. When the power-down signal pd at L level is supplied to the voltage generator circuit 1000 in the normal mode, the transistor Tr2 is turned off. Then, a voltage of an external power supply Vcc is reduced based on the reference voltage Vg, and the internal voltage Vdd is supplied to the internal circuit 1. At this time, since the resistor R201 has an extremely high resistance value, the resistor R201 will not affect the generation of the internal voltage.

The internal circuit 1 is a control circuit which is operative when cell information is written into or read from a memory cell of a dynamic random access memory (DRAM), and is comprised of a conventional CMOS circuit.

When the operation goes to the power-down mode from the normal mode to the power-down mode, the supply of the reference voltage Vg is stopped, and the power-down signal pd rises to H level. In response, the transistor Tr2 is turned on to discharge an accumulated charge on a capacitor C1, causing a gradual decrease in the reference voltage Vg supplied to a gate of the transistor Tr1.

When a potential difference between the reference voltage Vg and the internal voltage Vdd is equal to or smaller than a threshold value Vthn of the transistor Tr1, the transistor Tr1 is turned off. Then, the internal voltage Vdd falls to the voltage of the external power supply Vss.

When the potential difference between the reference voltage Vg and the internal voltage Vdd is equal to or smaller than the threshold value of the transistor Tr1, a sub-threshold current could flow into the transistor Tr1.

Figure 26:
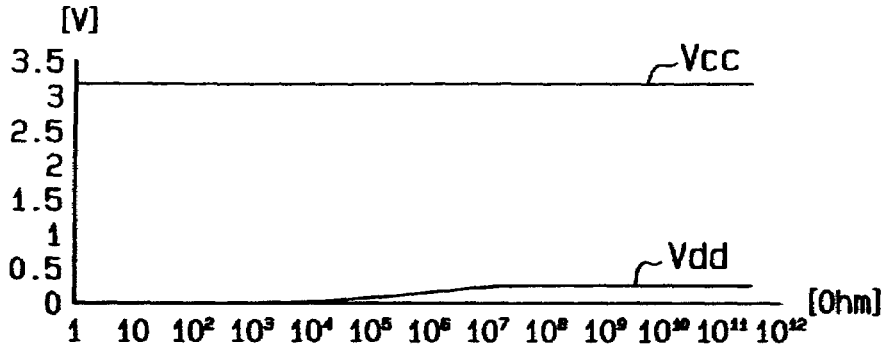
FIG. 26 is a graph showing the relationship between the resistance and the voltages in the voltage generator circuit of FIG. 15.

FIG. 26 is a graph showing the relationship between the resistance value of the resistor R201 and the internal voltage Vdd in the step-down circuit 1000 in the power-down mode.

When the resistor R201 has a resistance value of approximately $10^5$ Ω or greater with the external power supply Vcc at 3 V being supplied, the internal voltage Vdd is set to approximately 0.3 V by the sub-threshold current.

Figure 27:
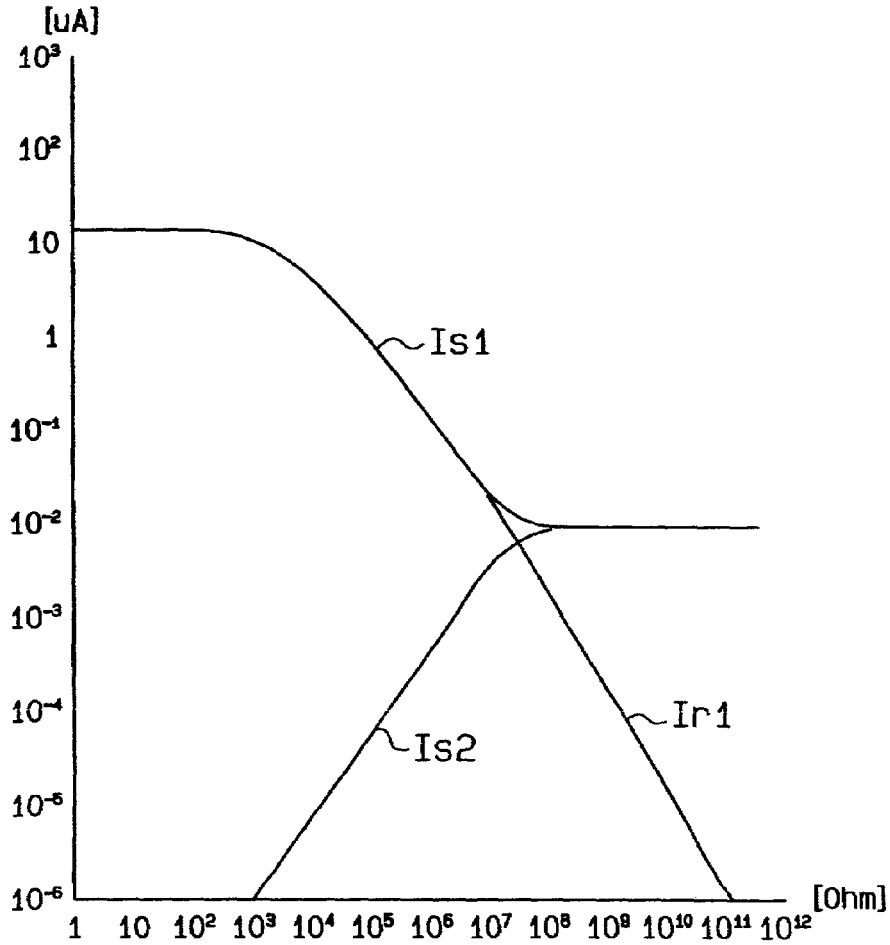
FIG. 27 is a graph showing the relationship between the resistance and the currents in the voltage generator circuit of FIG. 15.

FIG. 27 is a graph showing the relationships between the resistance value of the resistor R201 and currents including a sub-threshold current Is1 flowing into the transistor Tr1, a current Ir1 flowing through the resistor R201, and a sub-threshold current Is2 flowing into a transistor of the internal circuit 1.

When the resistor R201 has a resistance value of $10^5$ Ω or greater, i.e., 10 GΩ or greater, the sub-threshold current Is1 flowing into the transistor Tr1 balances the current Ir1 flowing through the resistor R201 and the sub-threshold current Is2 flowing into the transistor of the internal circuit 1 in accordance with the Kirchihoff's laws. In this case, a current consumed by the voltage generator circuit 1000 is approximately 0.01 μA, and the internal voltage Vdd is approximately 0.3 V.

Since the resistor R201 has an extremely high resistance value, the resistor R201 substantially provides a state in which the node N1 is not connected to the external power supply Vss.

The step-down circuit 1000 has the following advantages.

(1) With the node N1 connected to the external power supply Vss through the high resistor R201, the sub-threshold current Is2 flowing into the step-down transistor Tr1 is reduced in the power-down mode.

(2) In the prior art examples, a sub-threshold current amounting to several tens of μA flows into the step-down transistor Tr1 in the power-down mode. In the eighth embodiment, since the node N1 is connected to the external power supply Vss through the resistor R201 having a resistance value of 10 GΩ or more, the sub-threshold current Is1 flowing into the step-down transistor Tr1 is reduced to approximately 0.01 μA.

(3) The current consumption can be reduced in the power-down mode by reducing the sub-threshold current Is1.

Figure 28:
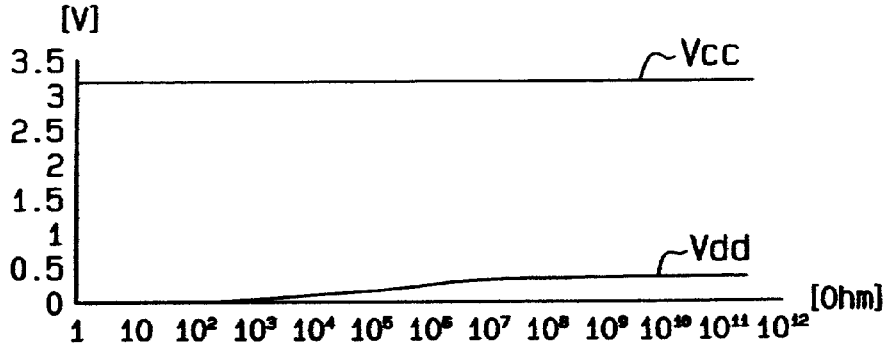
FIG. 28 is a graph showing the relationship between the resistance and the voltages in the voltage generator circuit of FIG. 15.
Figure 29:
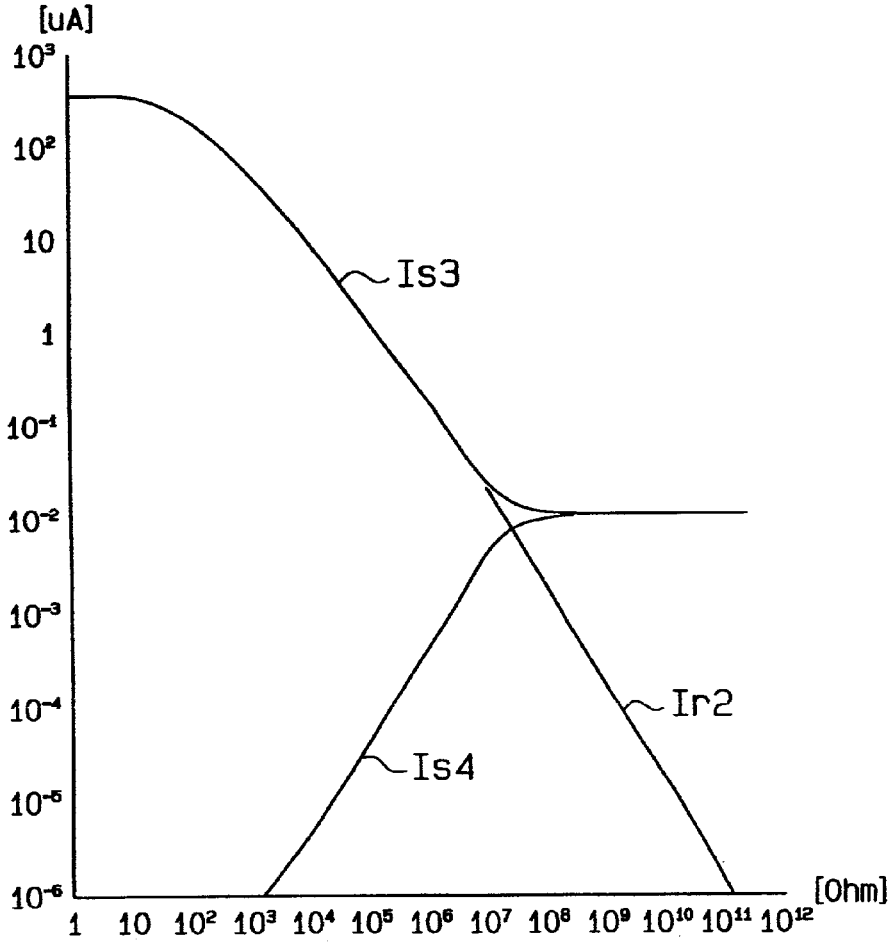
FIG. 29 is a graph showing the relationship between the resistance and the currents in the voltage generator circuit of FIG. 15.

(4) FIGS. 28 and 29 show the operation of the voltage generator circuit when the transistor Tr1 has a high current driving capability due to variations in the process. In this event, if the node N1 is connected to the external power supply Vss in the power-down mode as is the case with the prior art examples, a sub-threshold current of approximately 300 μA flows. By connecting a resistor R201 between the node N1 and the external power supply Vss, the sub-threshold current Is3 flowing into the transistor Tr1 is reduced to approximately 0.01 μA. At this time, the internal voltage Vdd is approximately 0.35 V.

Figure 16:
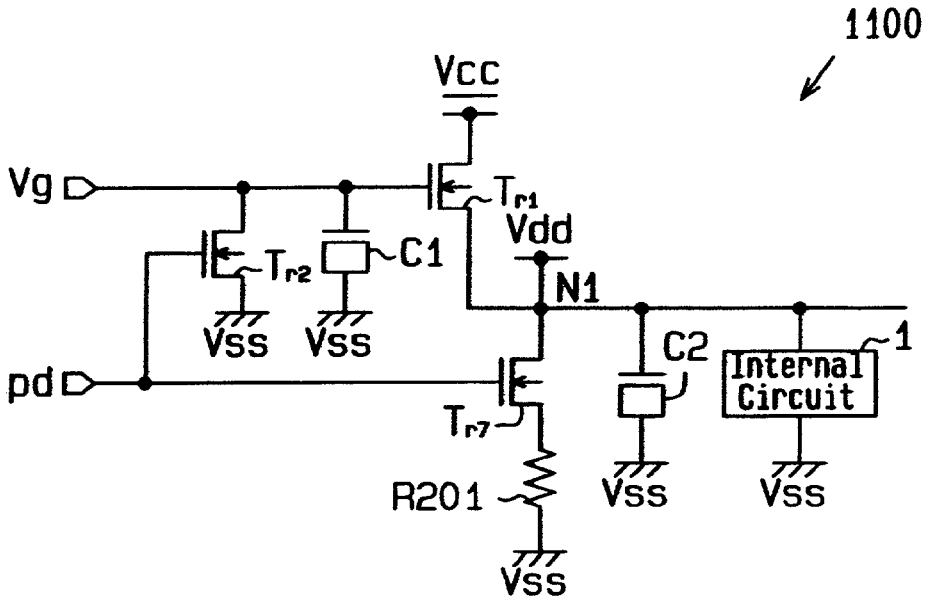
FIG. 16 is a schematic circuit diagram of a voltage generator circuit according to a ninth embodiment of the present invention.

FIG. 16 is a schematic circuit diagram of a voltage generator circuit 1100 according to a ninth embodiment of the present invention. The voltage generator circuit 1100 according to the ninth embodiment comprises an additional transistor Tr7 in the voltage generator circuit 1000 in the eighth embodiment.

The transistor Tr7, which is coupled between the node N1 and the resistor R201, is supplied with the power-down signal pd at the gate. The transistor Tr7 is turned off by the power-down signal pd at L level in the normal mode, and is turned on by the power-down signal pd at H level in the power-down mode. When the transistor Tr7 is turned on in the power-down mode, a sub-threshold current flowing into the transistor Tr1 is reduced by the resistor R201 in a manner similar to the eighth embodiment.

Since the transistor Tr7 is turned off in the normal mode, a current flowing from the node N1 to the external power supply Vss through the resistor R201 is shut off to further reduce the current consumption.

Figure 17:
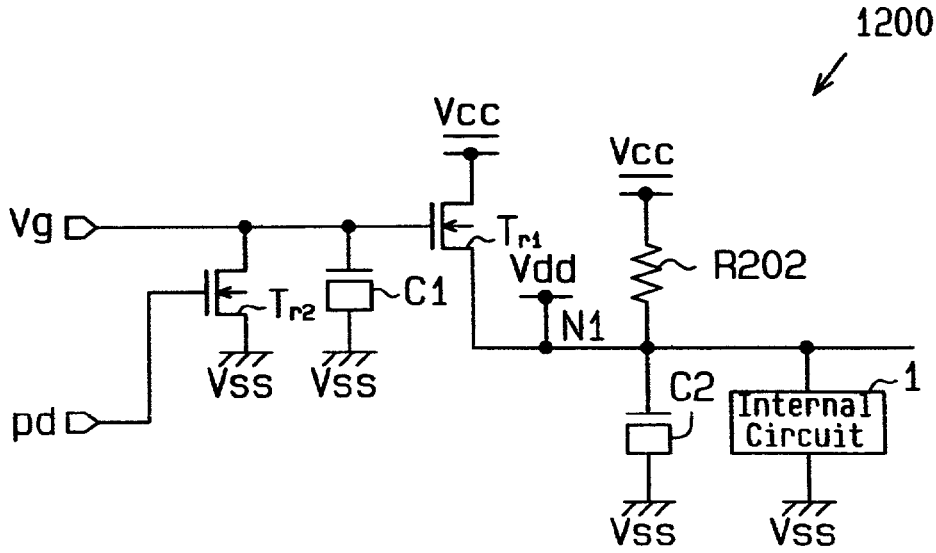
FIG. 17 is a schematic circuit diagram of a voltage generator circuit according to a tenth embodiment of the present invention.

FIG. 17 is a schematic circuit diagram of a voltage generator circuit 1200 according to a tenth embodiment of the present invention. The voltage generator circuit 1200 has a resistor R202 coupled between the node N1 and the external power supply Vcc in place of the resistor R201 of the eighth embodiment.

Figure 31:
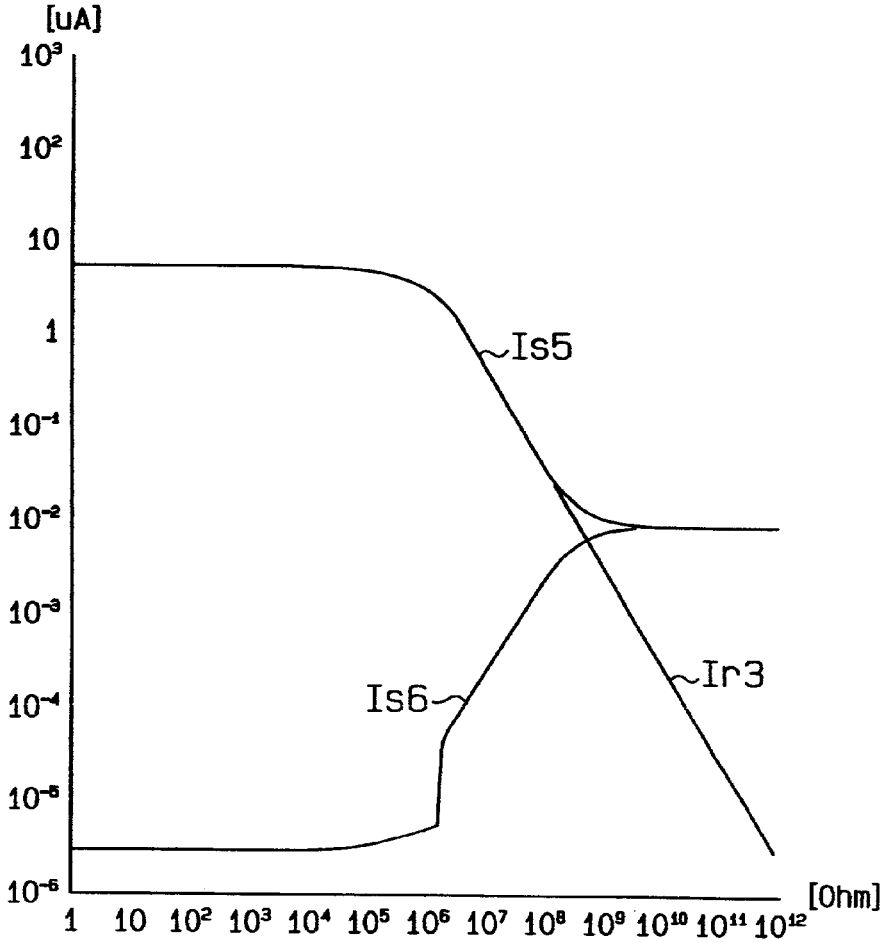
FIG. 31 is a graph showing the relationship between the resistance and the currents in the voltage generator circuit of FIG. 17.

In the tenth embodiment, the resistance value of the resistor R202 is set to $10^{10}\Omega$, i.e., 10GΩ or greater. When the resistor R202 has a low resistance value, the internal voltage Vdd is set to the voltage of the external power supply Vcc in the power-down mode, causing a sub-threshold current of approximately 5 μA to flow into the internal circuit 1 to increase the current consumption, as shown in FIG. 31.

Figure 30:
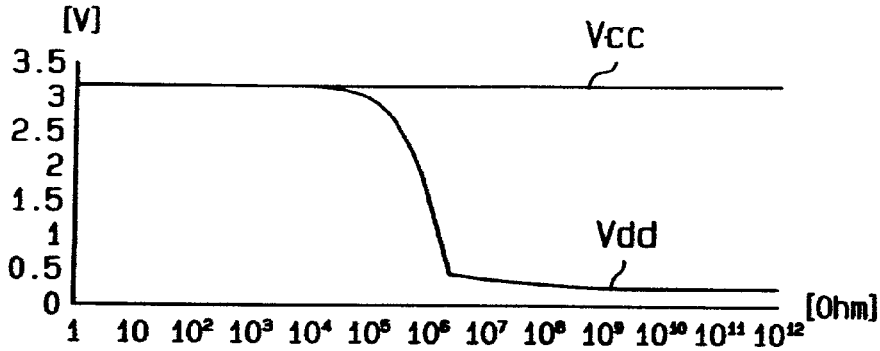
FIG. 30 is a graph showing the relationship between the resistance and the voltages in the voltage generator circuit of FIG. 17.

However, since the resistance of the resistor R202 is set to $10^{10}\Omega$, i.e., 10 GΩ or greater, the internal voltage Vdd is set to approximately 0.3 V when the transistor Tr1 is turned off in the power-down mode, as shown in FIG. 30. Also, as shown in FIG. 31, a sub-threshold current Is5 flowing into the transistor Tr1 and a current Tr3 flowing through the resistor R202 balance a sub-threshold current Is6 flowing into the internal circuit 1, causing a sub-threshold current Is5 of approximately 0.01 μA to flow into the transistor Tr1.

Thus, the voltage generator circuit 1200 according to the tenth embodiment has advantages similar to those of the voltage generator circuit 1000 according to the eighth embodiment.

Figure 32:
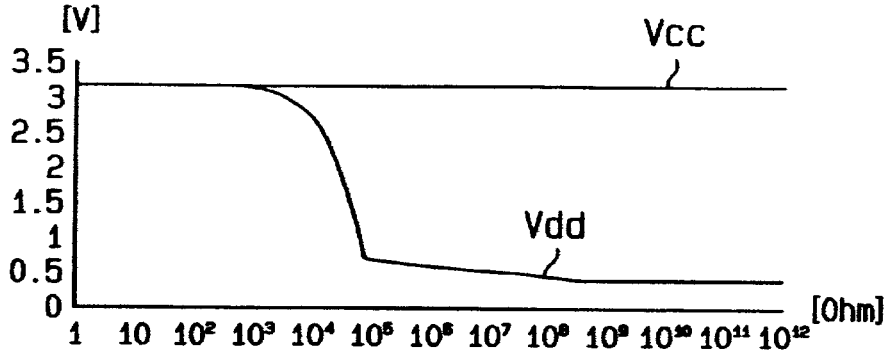
FIG. 32 is a graph showing the relationship between the resistance and the voltages in the voltage generator circuit of FIG. 17.
Figure 33:
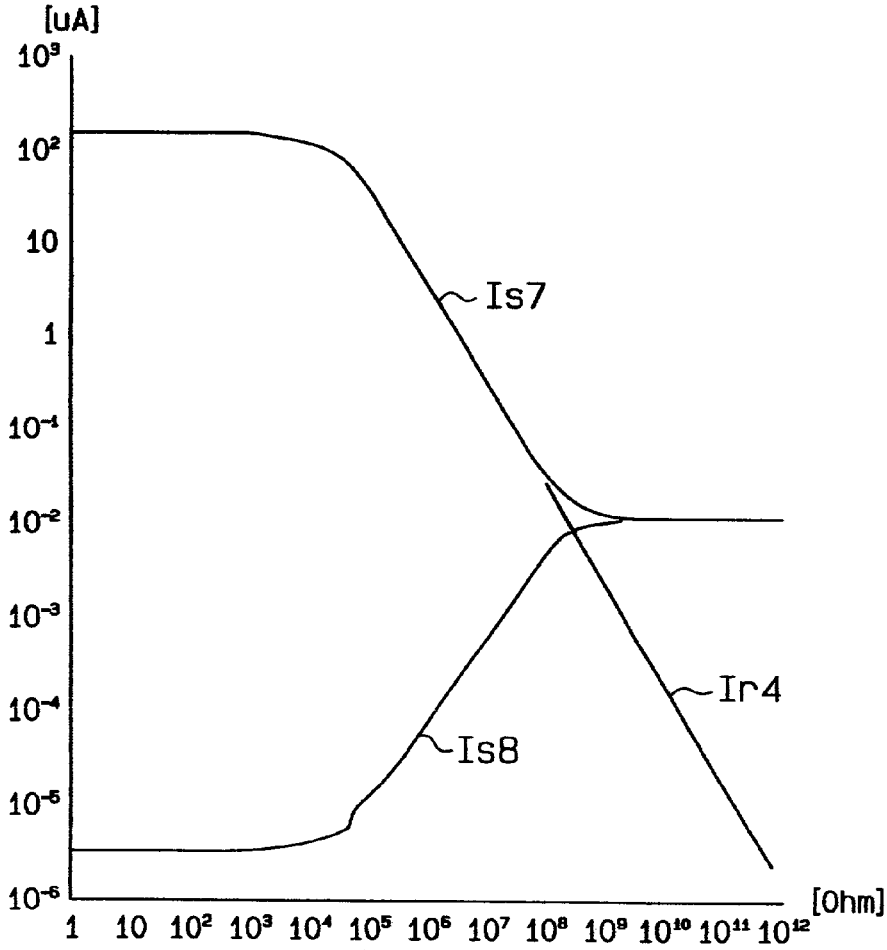
FIG. 33 is a graph showing the relationship between the resistance and the currents in the voltage generator circuit of FIG. 17.

FIGS. 32 and 33 show the operation of the voltage generator circuit 1200 when the transistor Tr1 has a high current driving capability due to variations in the process. In this event, when the node N1 is connected to the external power supply Vcc in the power-down mode as is the case with the prior art examples, a sub-threshold current Is7 of approximately 100 μA flows. In the tenth embodiment, the resistor R201 coupled between the node N1 and the external power supply Vcc reduces the sub-threshold current Is7 flowing into the transistor Tr1 to approximately 0.01 μA. At this time, the internal voltage Vdd is approximately 0.35 V.

Since the resistor R202 has an extremely high resistance value, the resistor R202 substantially provides a state in which the node N1 is not connected to the external power supply Vcc.

Figure 18:
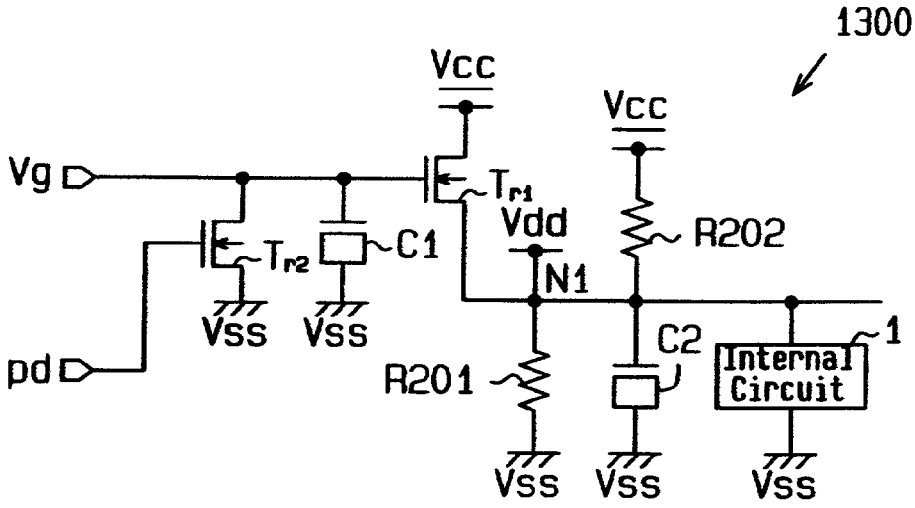
FIG. 18 is a schematic circuit diagram of a voltage generator circuit according to an eleventh embodiment of the present invention.

FIG. 18 is a schematic circuit diagram of a voltage generator circuit 1300 according to an eleventh embodiment of the present invention. The voltage generator circuit 1300 comprises the resistor R201 of the eighth embodiment and the resistor R202 of the tenth embodiment. The resistors R201, R202 have the same resistance values as those in the eighth and tenth embodiments, and will not affect the generation of the internal voltage Vdd in the normal operation mode.

When the transistor Tr1 is turned off in the power-down mode, a sub-threshold current flowing into the transistor Tr1 and a current flowing into the node N1 from the external power supply Vcc through the resistor R202 balance a current flowing into the external power supply Vss from the node N1 through the resistor R201 and a sub-threshold current flowing into the internal circuit 1. In this event, the internal voltage Vdd is approximately 0.3 V.

With the operation as described above, the eleventh embodiment also provides similar advantages to those of the eighth and tenth embodiments.

Figure 19:
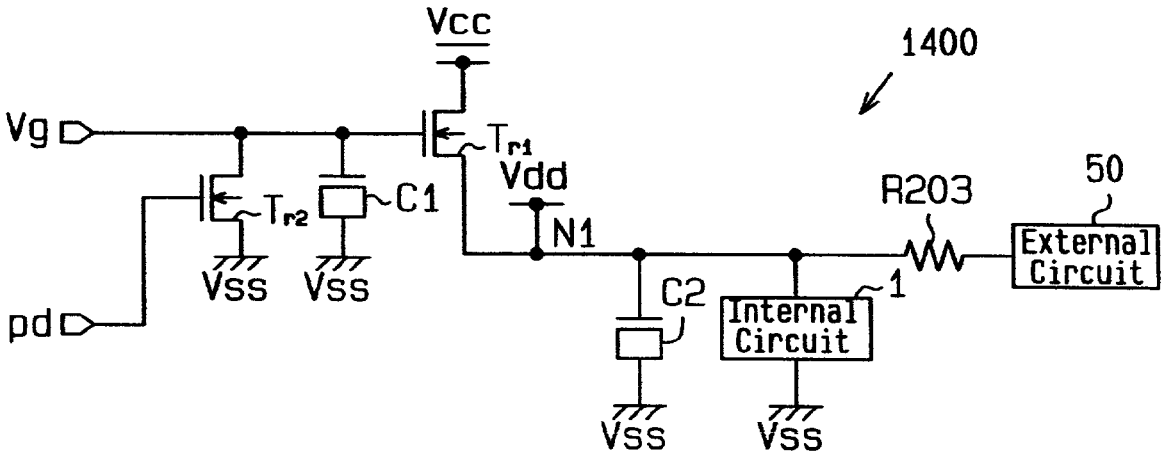
FIG. 19 is a schematic circuit diagram of a voltage generator circuit according to a twelfth embodiment of the present invention.

FIG. 19 is a schematic circuit diagram of a voltage generator circuit 1400 according to a twelfth embodiment of the present invention. In the twelfth embodiment, a voltage is supplied to the node N1 from an external circuit 50 through a resistor R203 such that an internal voltage Vdd is generated to reduce a sub-threshold current flowing into the transistor Tr1 in the power-down mode. The resistor R203 has a high resistance for preventing a sub-threshold current from being generated in the internal circuit 1.

The voltage supplied from the external circuit 50 includes a voltage which forces an external reference voltage Vref, an internal voltage Vpp greater than the voltage of the external power supply Vcc, a voltage Vbb smaller than the voltage of the external power supply Vss, an internal reference voltage Vpr, or a voltage that provides a balance of a sub-threshold current of the transistor Tr1 and the sub-threshold current flowing into the internal circuit.

The external circuit 50 is preferably a circuit which has a low current supply capability and therefore consumes lower power in the power-down mode. Also, the capability of the external circuit 50 may be controlled in the normal mode.

The voltage supplied from the external circuit 50 may be clamped to the voltage of the external power supply Vcc or Vss in the power-down mode.

Figure 20:
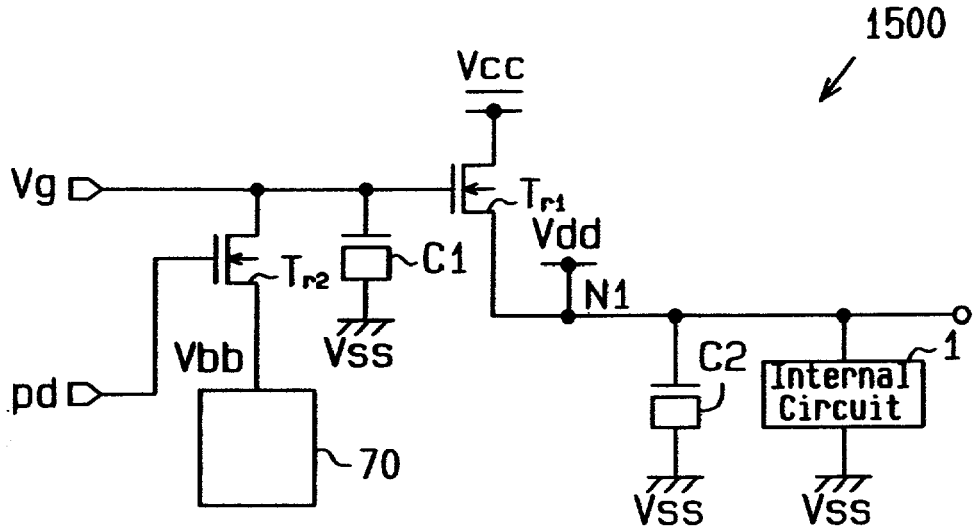
FIG. 20 is a schematic circuit diagram of a voltage generator circuit according to a thirteenth embodiment of the present invention.

FIG. 20 is a schematic circuit diagram of a voltage generator circuit 1500 according to a thirteenth embodiment of the present invention. The voltage generator circuit 1500 according to the thirteenth embodiment is an exemplary modification to the voltage generator circuit 1000 according to the eighth embodiment, wherein the reference voltage clamp transistor Tr2 is supplied at the source with a substrate current Vbb smaller than the voltage of the external power supply Vss from a substrate potential generator circuit 70. The substrate voltage Vbb thus supplied prevents the generation of a sub-threshold current in the transistor Tr1 in the power-down mode.

The thirteenth embodiment omits the resistor R201 in the voltage generator circuit 1000 of the eighth embodiment.

In the normal mode, the voltage generator circuit 1500, which operates in a manner similar to the voltage generator circuit 1000 of the eighth embodiment, step-downs the external power supply Vcc to generate an internal voltage Vdd.

In the power-down mode, the transistor Tr2 is turned on by the power-down signal pd at H level to apply the substrate voltage Vbb to the gate of the transistor Tr1. The substrate voltage Vbb is a voltage for setting a gate-to-source voltage of the transistor Tr1 to −0.5 V or greater. In this event, no sub-threshold current flows into the transistor Tr1, and no sub-threshold current flows either into the internal circuit 1.

The substrate voltage generator circuit 70 is preferably a circuit for controlling only the gate potential of the transistor Tr1 in the power-down mode and has an extremely small driving capability.

The substrate voltage Vbb may be supplied using a conventional substrate voltage generator circuit. In this case, the substrate voltage generator circuit preferably has a driving capability required to control the gate potential of the transistor Tr1 alone in the power-down mode. In other words, the driving capability of the substrate voltage generator circuit may be reduced in the power-down mode.

In the thirteenth embodiment, the sub-threshold current is prevented from being generated in the power-down mode to reduce the current consumption.

Figure 21:
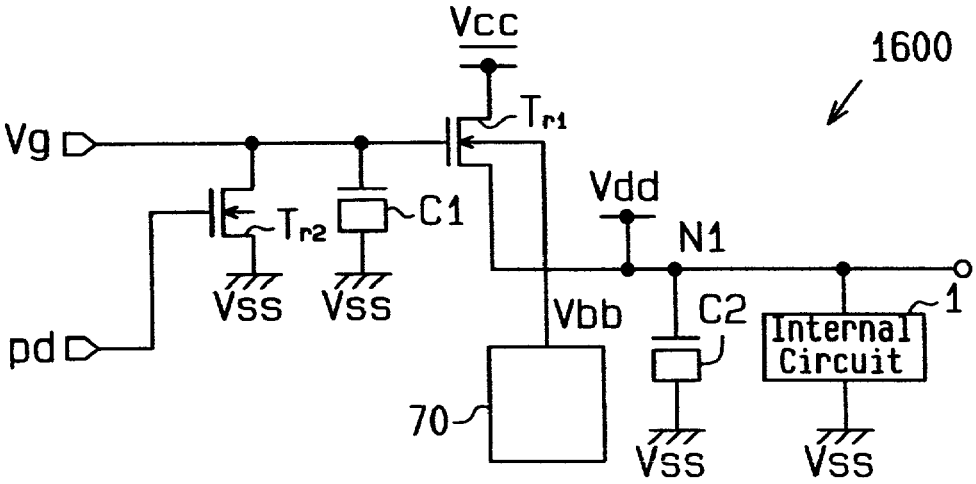
FIG. 21 is a schematic circuit diagram of a voltage generator circuit according to a fourteenth embodiment of the present invention.

FIG. 21 is a schematic circuit diagram of a voltage generator circuit 1600 according to a fourteenth embodiment of the present invention. In the voltage generator circuit 1600 according to the fourteenth embodiment, the substrate potential generator circuit 70 supplies a back gate of a transistor Tr1 with the substrate voltage Vbb smaller than the voltage of the external power supply Vss which is supplied to the source of the transistor Tr2.

When an N-channel MOS transistor is supplied at its back gate with a voltage smaller than a source potential, a threshold value increases in accordance with the relationship between a channel region and a depletion layer. Thus, the substrate voltage Vbb supplied to the back gate causes the threshold value of the transistor Tr1 to increase. For this reason, no sub-threshold current flows into the transistor Tr1 when the gate voltage of the transistor Tr1 is set to the voltage of the external power supply Vss in the power-down mode.

The fourteenth embodiment prevents the generation of the sub-threshold current in the transistor Tr1 and a sub-threshold current in the internal circuit 1 in the power-down mode to reduce the current consumption.

Figure 22:
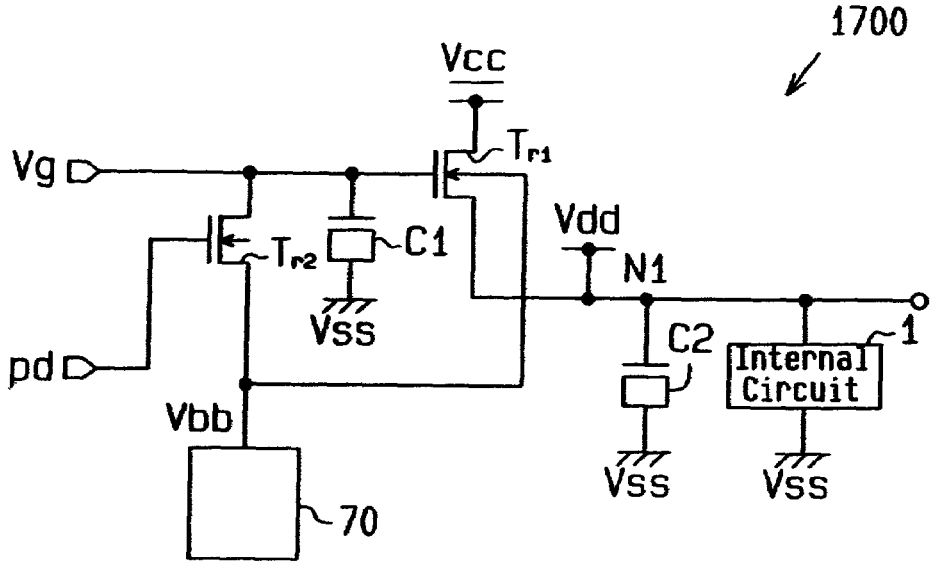
FIG. 22 is a schematic circuit diagram of a voltage generator circuit according to a fifteenth embodiment of the present invention.

FIG. 22 is a schematic circuit diagram of a voltage generator circuit 1700 according to a fifteenth embodiment of the present invention. The voltage generator circuit 1700 is a combination of the voltage generator circuit 1500 of the thirteenth embodiment and the voltage generator circuit 1600 of the fourteenth embodiment.

The substrate potential generator circuit 70 supplies the source of the transistor Tr2 and the back gate of the transistor Tr1 with the substrate voltage Vbb smaller than the external power supply Vss. In this event, the threshold value of the transistor Tr1 further increases as compared with the thirteenth embodiment and fourteenth embodiment. Therefore, the generation of sub-threshold currents is prevented in the power-down mode to reduce the current consumption.

Figure 23:
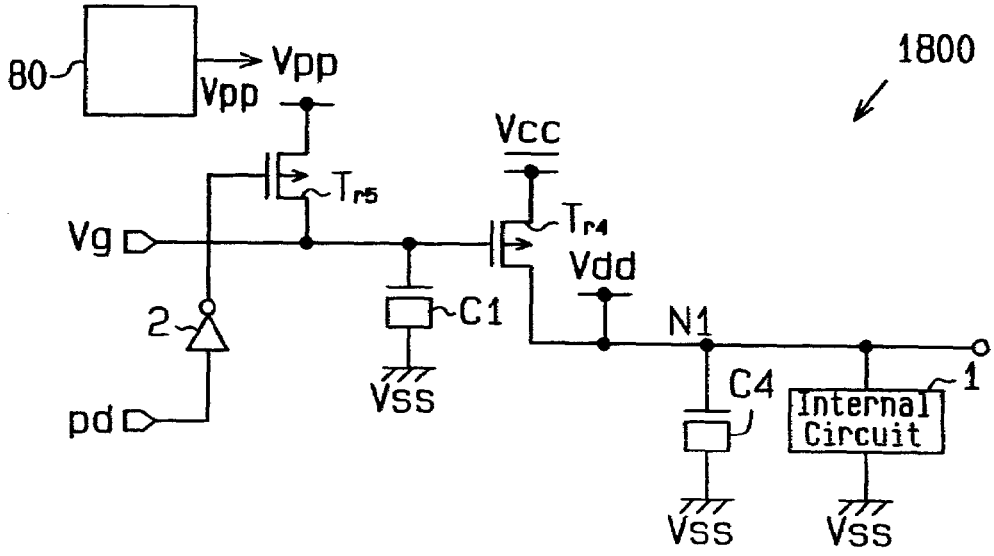
FIG. 23 is a schematic circuit diagram of a voltage generator circuit according to a sixteenth embodiment of the present invention.

FIG. 23 is a schematic circuit diagram of a voltage generator circuit 1800 according to a sixteenth embodiment of the present invention. The voltage generator circuit 1800 is an improvement in the prior art example illustrated in FIG. 2, wherein the step-down transistor Tr4 and the reference voltage clamp transistor Tr5 are comprised of P-channel MOS transistors.

The transistor Tr5 is supplied at the source with a boost voltage Vpp, which is greater than the voltage of the external power supply Vcc, from an external circuit 80. The voltage generator circuit (step-down circuit) 1800 operates in a similar manner to the prior art example in the normal mode.

In the power-down mode, the transistor Tr5 is turned on, while the transistor Tr4 is turned off. In this event, since the gate voltage of the transistor Tr4 rises to the boost voltage Vpp, and is therefore set greater than a source potential, no sub-threshold current flows into the transistor Tr4.

The circuit 80 for supplying the boost voltage Vpp may have a minimum capability for driving the gate of the transistor Tr4 alone in the power-down mode. Alternatively, the circuit 80 may be controlled to have a minimum capability in the power-down mode.

The sixteenth embodiment prevents the generation of the sub-threshold currents in the power-down mode to reduce the current consumption.

Figure 24:
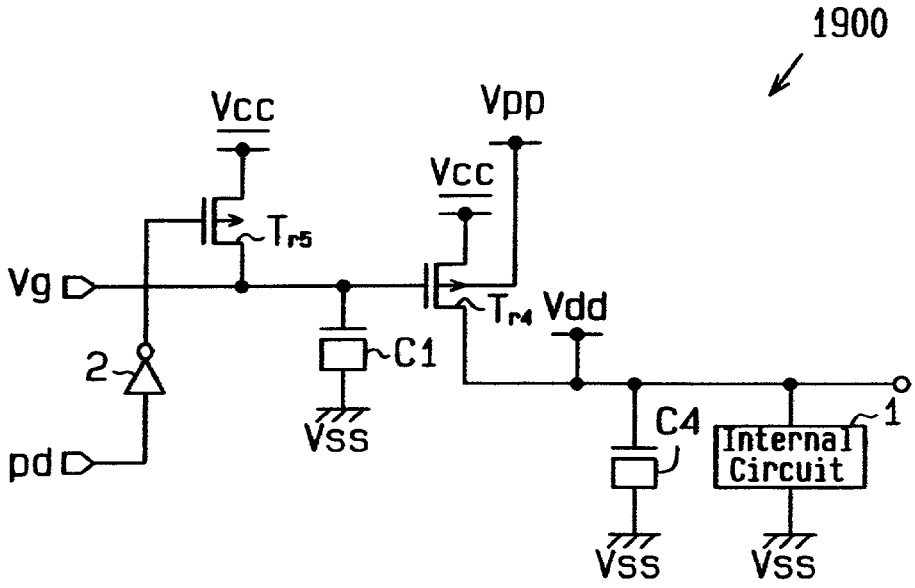
FIG. 24 is a schematic circuit diagram of a voltage generator circuit according to a seventeenth embodiment of the present invention.

FIG. 24 is a schematic circuit diagram of a voltage generator circuit 1900 according to a seventeenth embodiment of the present invention. In the voltage generator circuit 1900, a step-down transistor Tr4, comprised of a P-channel MOS transistor, is supplied with a boost voltage Vpp at the back gate. In response, the threshold value of the transistor Tr4 increases, so that the transistor Tr4 is turned off if the gate potential of the transistor Tr4 is set to the voltage of the external power supply Vcc in the power-down mode. In this event, however, no sub-threshold current flows into the transistor Tr4. Also, since no sub-threshold current flows into the transistor Tr4, no sub-threshold current will either flow into the internal circuit 1. Consequently, the generation of the sub-threshold current is prevented in the power-down mode to reduce the current consumption.

Figure 25:
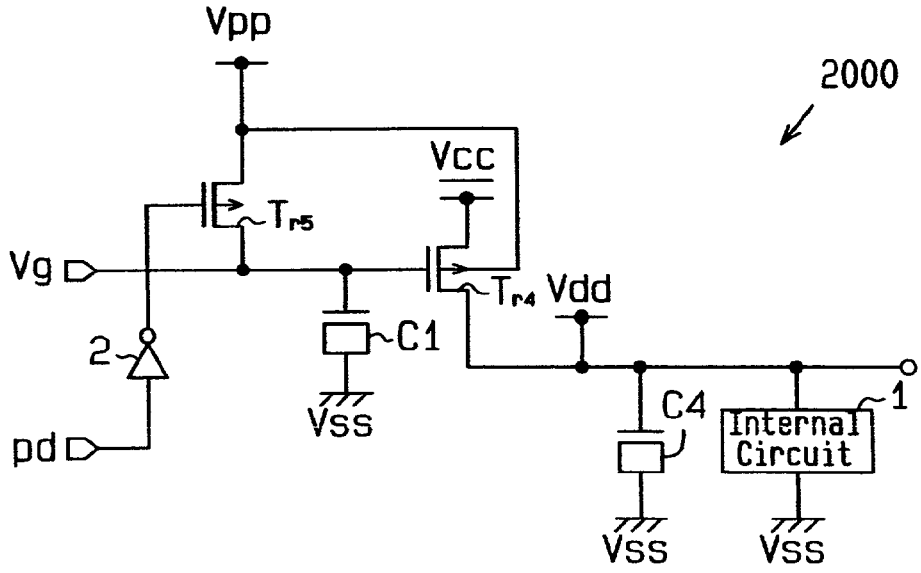
FIG. 25 is a schematic circuit diagram of a voltage generator circuit according to an eighteenth embodiment of the present invention.

FIG. 25 is a schematic circuit diagram of a voltage generator circuit 2000 according to an eighteenth embodiment of the present invention. The voltage generator circuit 2000 is a combination of the voltage generator circuit 1800 of the sixteenth embodiment and the voltage generator circuit 1900 of the seventeenth embodiment.

In the eighteenth embodiment, the boost voltage Vpp is supplied to the source of the transistor Tr5 and the back gate of the transistor Tr4. Therefore, as compared with the sixteenth embodiment and the seventeenth embodiment, the threshold value of the transistor Tr4 further increases. Consequently, the generation of the sub-threshold current is prevented in the power-down mode to reduce the current consumption.

It should be apparent to those skilled in the art that the present invention may be embodied in many other specific forms without departing from the spirit or scope of the invention. Particularly, it should be understood that the invention may be embodied in the following forms.

In the voltage generator circuit 500 of the third embodiment, the transistor Tr20 may be omitted.

In the power-down mode, the internal voltage Vdd may be set to an intermediate value between a predetermined internal voltage and the voltage of the low potential power supply Vss. In this event, when the operation mode goes to the normal mode from the power-down mode, the internal voltage vdd can be promptly recovered from the voltage of the low potential power supply Vss.

In the second through fourth embodiments, the reference voltage Vg may be set to an intermediate value between a predetermined reference voltage and the voltage of the low potential power supply Vss in the power-down mode. In this event, when the operation mode goes to the normal mode from the power-down mode, the reference voltage Vg can be promptly recovered from the low potential power supply Vss.

In the fifth embodiment, the reference voltage Vg may be set to an intermediate value between a predetermined reference voltage and the voltage of the high potential power supply Vdd in the power-down mode. In this event, when the operation mode goes to the normal mode from the power-down mode, the reference voltage Vg can be promptly recovered from the high potential power supply Vdd.

In the seventh through eighteenth embodiments, the gate potential of the N-channel MOS transistor of the internal circuit 1 may be set smaller than the source potential of the same in the power-down mode to prevent the generation of the sub-threshold currents.

In the seventh through eighteenth embodiments, the gate potential of the N-channel MOS transistor of the internal circuit 1 may be set greater than the source potential of the same in the power-down mode to prevent the generation of the sub-threshold currents.

In the respective voltage generator circuits 1500, 1600, 1700, 1800, 1900, 2000 of FIGS. 20 through 25, when the step-down transistor is turned off, the node N1 becomes instable. Therefore, a transistor may be coupled between the node N1 and the external power supply Vss such that the transistor is turned on in response to the power-down signal pd to clamp the voltage of the node N1 to the voltage of the external power supply Vss.

Therefore, the present examples and embodiments are to be considered as illustrative and not restrictive and the invention is not to be limited to the details given herein, but may be modified within the scope and equivalence of the appended claims.

What is claimed is:

1. A voltage generator circuit comprising:

a voltage generator activated by a reference voltage to generate an output voltage;

a reference voltage clamp circuit coupled to the voltage generator for clamping the reference voltage to a predetermined clamp voltage in response to a power-down signal to deactivate the voltage generator; and a sub-threshold current reduction circuit including a resistor coupled between the voltage generator and one of a high potential power supply and a low potential power supply, wherein a resistance value of the resistor is at least $10^5$ Ω to maintain the output voltage to a value slightly higher than the voltage of the low potential power supply so that a sub-threshold current flowing into the voltage generator is reduced when the voltage generator is deactivated.

2. A voltage generator circuit comprising:

a voltage generator activated by a reference voltage to generate an output voltage;

a reference voltage clamp circuit coupled to the voltage generator for clamping the reference voltage to a predetermined clamp voltage in response to a power-down signal to deactivate the voltage generator; and a sub-threshold current reduction circuit for reducing a sub-threshold current flowing into the voltage generator when the voltage generator is deactivated, wherein the output signal is supplied to an internal circuit of a semiconductor device, and the sub-threshold current reduction circuit includes a balance voltage setting circuit for setting a balance voltage at which the sub-threshold current flowing into the voltage generator balances a sub-threshold current flowing into the internal circuit.

3. The voltage generator circuit according to claim 2, wherein the voltage generator includes an N-channel MOS transistor having a drain which receives a high potential supply voltage, a gate which receives the reference voltage, and a source, and the balance voltage setting circuit includes a resistor coupled between the source of the N-channel MOS transistor and an external power supply and having a high resistance.

4. The voltage generator circuit according to claim 3, wherein the resistor is coupled between the source of the N-channel MOS transistor and one of an external high potential power supply and an external low potential power supply.

5. The voltage generator circuit according to claim 4, further comprising a switch for connecting a resistance between the source of the N-channel MOS transistor and one of the high potential power supply and the low potential power supply.

6. The voltage generator circuit according to claim 2, wherein the voltage generator includes an N-channel MOS transistor having a drain which receives a high potential supply voltage, a gate which receives the reference voltage, and a source, and the balance voltage setting circuit supplies the balance voltage to the source of the N-channel MOS transistor.

7. A voltage generator circuit comprising:

a voltage generator activated by a reference voltage to generate an output voltage, wherein the voltage generator includes a transistor having a gate and a back gate;

a reference voltage clamp circuit coupled to the voltage generator for clamping the reference voltage to a predetermined clamp voltage in response to a power-down signal to deactivate the voltage generator; and a sub-threshold current shut-off circuit for shutting off generation of a sub-threshold current of the voltage generator by controlling a voltage directly applied to the back gate of the transistor of the voltage generator, and wherein the sub-threshold current shut-off circuit sets a predetermined clamp voltage at the gate of the transistor to a voltage at which the sub-threshold current can be shut off by controlling a voltage applied to the reference voltage clamp circuit.

8. The voltage generator circuit according to claim 7, wherein the transistor is an N-channel MOS transistor, and the sub-threshold current shut-off circuit supplies a substrate voltage smaller than a voltage of the low potential power supply to the gate of the N-channel MOS transistor.

9. The voltage generator circuit according to claim 7, wherein the transistor is a P-channel MOS transistor, and the sub-threshold current shut-off circuit supplies a boost voltage greater than a voltage of the high potential power supply to the gate of the P-channel MOS transistor.

10. The voltage generator circuit according to claim 7, wherein the MOS transistor is an N-channel MOS transistor, and the sub-threshold current shut-off circuit supplies the back gate of the N-channel MOS transistor with a substrate voltage smaller than a voltage of a low potential power supply.

11. The voltage generator circuit according to claim 7, wherein the transistor is a P-channel MOS transistor, and the sub-threshold current shut-off circuit supplies the back gate of the P-channel MOS transistor with a boost voltage greater than a voltage of a high potential power supply.

12. A semiconductor device comprising:

a voltage generator circuit including:

a voltage generator activated by a reference voltage to generate an output voltage;

a reference voltage clamp circuit coupled to the voltage generator for clamping the reference voltage to a predetermined clamp voltage in response to a power-down signal to deactivate the voltage generator; and a sub-threshold current reduction circuit including a resistor coupled between the voltage generator and one of a high potential power supply and a low potential power supply, wherein a resistance value of the resistor is at least $10^5\Omega$ to maintain the output voltage to a value slightly higher than the voltage of the low potential power supply so that a sub-threshold current flowing into the voltage generator is reduced when the voltage generator is deactivated; and an internal circuit coupled to the voltage generator and enabled by the output voltage.

13. A method of controlling a voltage generator circuit having a voltage generator for generating an internal voltage supplied to an internal circuit, comprising the steps of:

deactivating the voltage generator in response to a power-down signal; and setting the internal voltage of the voltage generator to a balance voltage at which a sub-threshold current flowing into the voltage generator balances a sub-threshold current flowing into the internal circuit when the voltage generator is deactivated.

* * * * *